United States Patent [19]

Nakao

[11] 4,371,076

[45] Feb. 1, 1983

[54] APPARATUS FOR CONVEYING AND CLOSELY GATHERING FOOD

[76] Inventor: Yasutaka Nakao, No. 207 Mutsuzane Gokō, Matsudo-shi, Chiba-ken, Japan

[21] Appl. No.: 197,693

[22] Filed: Oct. 16, 1980

Related U.S. Application Data

[63] Continuation-in-part of Ser. No. 91,039, Nov. 5, 1979, which is a continuation of Ser. No. 925,166, Jul. 17, 1978, abandoned, which is a continuation of Ser. No. 849,622, Nov. 8, 1977, abandoned, which is a continuation of Ser. No. 774,965, Mar. 7, 1977, abandoned, which is a continuation of Ser. No. 701,979, Jul. 1, 1976, abandoned, which is a continuation of Ser. No. 548,922, Feb. 11, 1975, abandoned.

[30] Foreign Application Priority Data

Mar. 6, 1974 [JP] Japan ..... 49-25686[U]

[51] Int. Cl.[3] ..... B65B 42/26; B65B 57/03

[52] U.S. Cl. ..... 198/420; 198/422; 198/429; 198/431

[58] Field of Search ..... 198/420, 422, 424–426, 198/429–431, 460, 462, 465, 466, 469, 503, 572, 575; 53/239, 243–244, 251

[56] References Cited

U.S. PATENT DOCUMENTS

| | | | |
|---|---|---|---|
| 3,130,614 | 9/1964 | Scarda | 198/422 X |
| 3,354,613 | 11/1967 | Anderson et al. | 53/231 |
| 3,427,779 | 2/1969 | Goldman | 198/431 X |
| 3,870,139 | 3/1975 | Wagner | 198/462 X |

*Primary Examiner*—John J. Love
*Assistant Examiner*—Douglas D. Watts
*Attorney, Agent, or Firm*—Stevens, Davis, Miller & Mosher

[57] ABSTRACT

A grouping apparatus for articles, in which articles conveyed from plural wrapping machines or plural production equipment are respectively transferred through the feeding conveyors to grouping conveyors driven intermittently and grouped as a group in a row on the conveyor. The groups in rows are then grouped for loading a tray and conveyed to a tray loader.

6 Claims, 22 Drawing Figures

This sequence diagram is used for the grouping divice from A or A'. The same sequence diagram for the grouping divice from B or B' is same.

For grouping device from B or B', this sequence diagram continue from FIG. 13.

For grouping device from A or A', this sequence diagram continue from FIG. 13.

APPARATUS FOR CONVEYING AND CLOSELY GATHERING FOOD

This is a continuation-in-part application of Ser. No. 91,039 filed Nov. 5, 1979 which in turn is a continuation of application Ser. No. 925,166 filed July 17, 1978, now abandoned which in turn is a continuation of application Ser. No. 849,622 filed Nov. 8, 1977, now abandoned, which in turn is a continuation of application Ser. No. 774,965 filed Mar. 7, 1977, now abandoned, which in turn is a continuation of application Ser. No. 701,979 filed July 1, 1976, now abandoned, and which in turn is a continuation of application Ser. No. 548,922 filed Feb. 11, 1975, now abandoned.

DESCRIPTION OF THE PRIOR ART

Heretofore, various types of article grouping apparatus have been proposed, but only for handling simple articles which are comparatively solid and regular in size and shape. The heretofore apparatus has not been able to deal with soft and irregular articles in large quantities in an industrial process.

In modern and large scale foods plants, it is necessary to handle various soft and irregular articles on plural production lines provided with wrapping machines or bagging machines.

However, there have not been any systematic machines or apparatuses having a single loading unit which can handle the above articles.

SUMMARY OF THE INVENTION

This invention relates to an automatic grouping and conveying apparatus having plural grouping devices for grouping individual article into a group in a row, a second grouping device for grouping said grouped row into a final group and a loading device.

It is a main object of the present invention to provide a grouping apparatus to respectively group articles supplied from plural production lines or wrapping machines into grouped rows and to transfer at a predetermined pitch between the top article row of an adjoining finished article group or multiple of said pitch onto one next related conveyor for finishing a final group and discharging the group to a loading device.

It is an another object of the present invention to provide a grouping apparatus to respectively group articles supplied from plural production lines or wrapping machines into grouped rows and to respectively transfer onto the next related conveyor for finishing a final group and to transfer at a predetermined pitch between the top article row of an adjoining finished article group or multiple of said pitch onto one next related conveyor for discharging the group to a loading device.

A further object of the present invention is to provide a grouping device and individual device for the purpose of the above mentioned object.

DETAILED DESCRIPTION OF THE INVENTION

Figure 1:
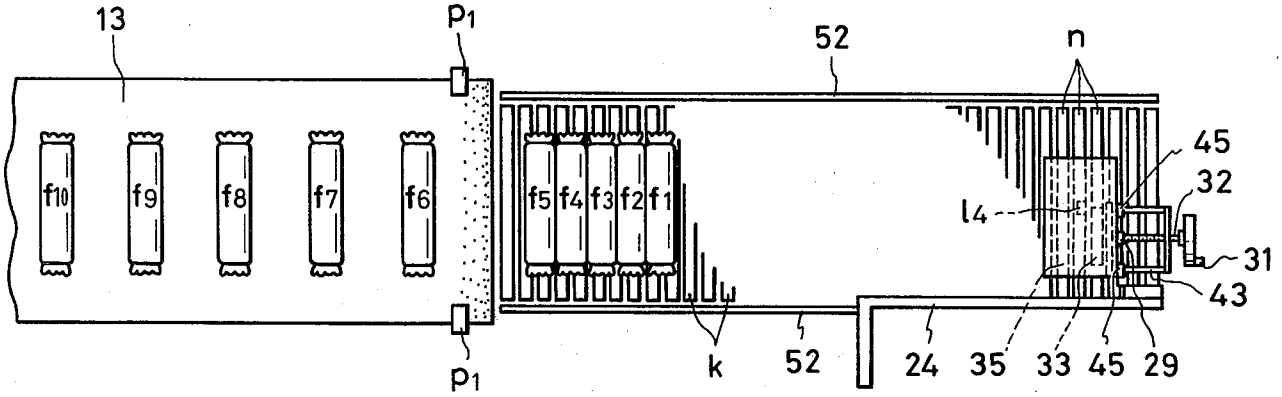
FIG. 1 is a plan view of a principal part of the apparatus used in preparing a group.
Figure 2:
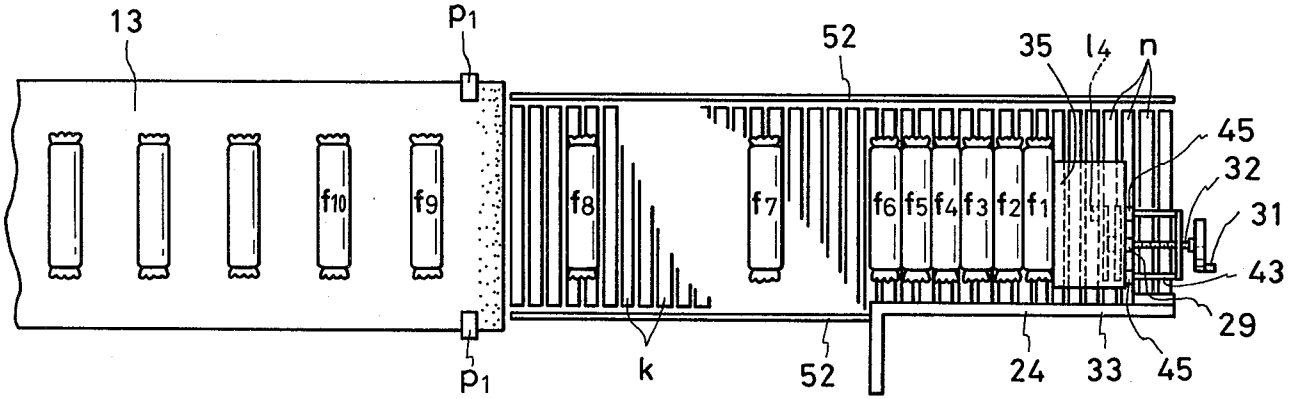
FIG. 2 is a plan view of the apparatus when articles are grouped at a stopper.

Referring now to FIGS. 1 to 6, two horizontal members (one not shown) 2 (FIG. 5) are horizontally fit to two pair of legs 1, (one pair not shown) on floor G. A motor M which drives feeding conveyor 13 (described later) and a clutch and brake unit $CE_1$ are arranged on the horizontal member 2. Pulley Mo fixed on the motor shaft m drives pulley 10' by belt 48'. Pulley 10' and driving pulley 10 are fixed on shaft 10''. Pulley 3 fixed on the motor shaft m drives belt (a). Driven pulley 4 is fixed on the input shaft of the clutch and brake unit $CE_1$. Pulley 6 and cam 7 are fixed on shaft (b) and supported on bearings in bearing housing 5 fitted on one side of the legs 1. Belt (d) is passed around driven pulley 6 and driving pulley 4' is fixed on the output shaft of the clutch and brake unit $CE_1$. Microswitch 8 is mounted on arm 9 suspended from support member S. Actuater e of microswitch 8 is arranged so that a contact in microswitch 8 may close or open according to whether the projection of cam 7 pushes or doesn't push actuater e. The opposite ends of support member S are fixed to legs 1, so that support member S is arranged parallel to and above horizontal member 2. Bearing housings 5' fitted on support members S support driving shaft 10'', driving pulley 10 and driven pulley 10'. Adjusting rollers 11 and 12 are rotatably supported in the leftside and the rightside (in FIG. 5) on the upper ends of both pair of legs 1. Endless belt 48 is passed around driving pulley 10 and adjusting rollers 11, 12. Adjusting rollers 46, 47 supported above and on upper opposite sides of driving pulley 10 are provided to give suitable tension to belt 48. The conveyor above mentioned is generally named the feeding conveyor 13.

A set of photocells $p_1$, $p_1$ are arranged over the belt surface of feeding conveyor 13 in a counting position. A signal from photocell $p_1$ activates a clutch (not shown) and simultaneously releases the brake (not shown) in the clutch and brake unit $CE_1$, when articles $f_1$, $f_2$, $f_3$, etc. with suitable space between each other pass through between photocells $p_1$, $p_1$ and interrupt the light beam. By the motion of the clutch and brake, cam 7 rotates until the contact of microswitch 8 is closed and opened. When microswitch 8 is open after closing, the clutch releases and activates the brake in the clutch and brake unit $CE_1$, to immediately stop cam 7. Articles $f_1$, $f_2$, $f_3$, etc. which pass between photocells $p_1$, $p_1$ are counted by the signal of the closing of the contact of the microswitch 8, the signal activating a clutch (not shown) simultaneously releases a brake in the clutch and brake unit $CE_2$ described hereinafter. At the same time, grouping conveyor 54 (described later) which follows feeding conveyor 13 is driven by $CE_2$, and after a predetermined time, the clutch of $CE_2$ is released and the brake is activated by timer ii so that grouping conveyor 54 is immediately stopped.

Figure 4:
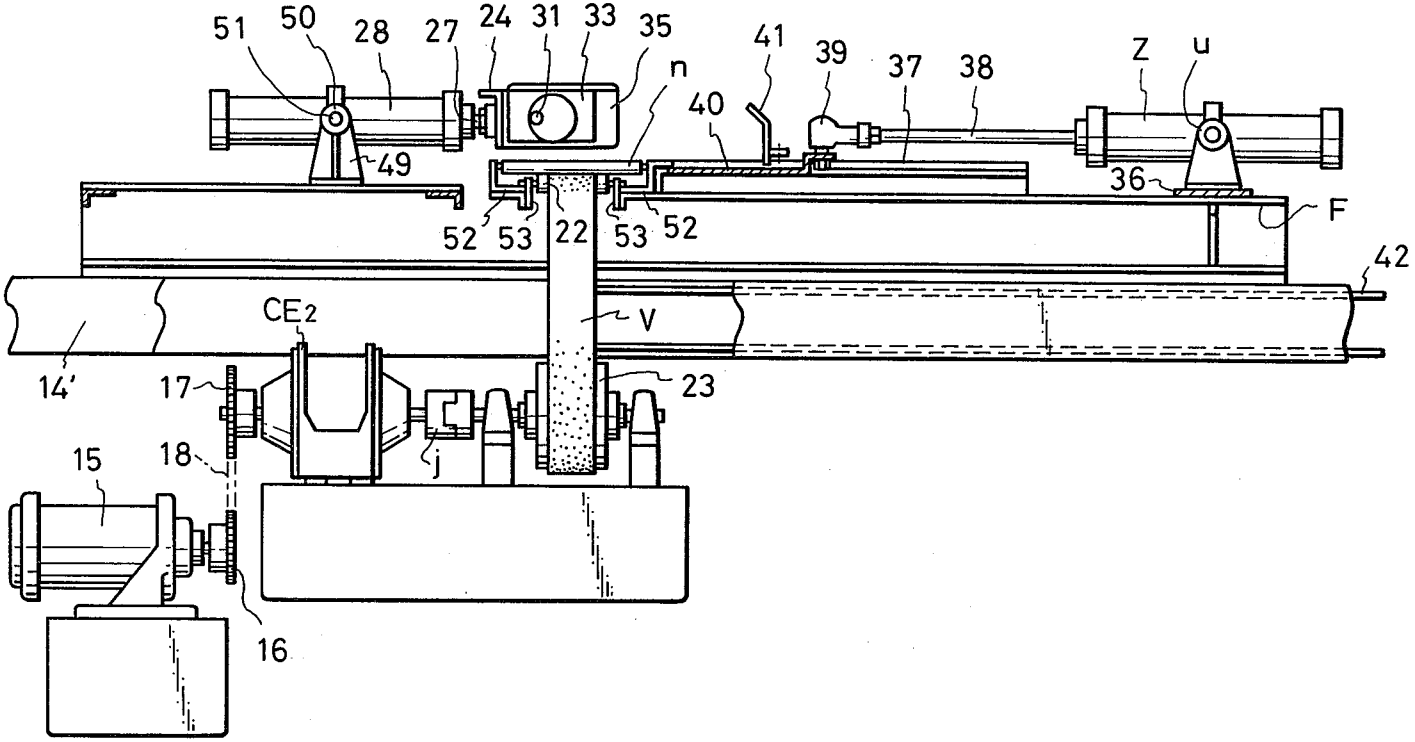
FIG. 4 is a vertical section taken along the line IV—IV of FIG. 3.
Figure 5:
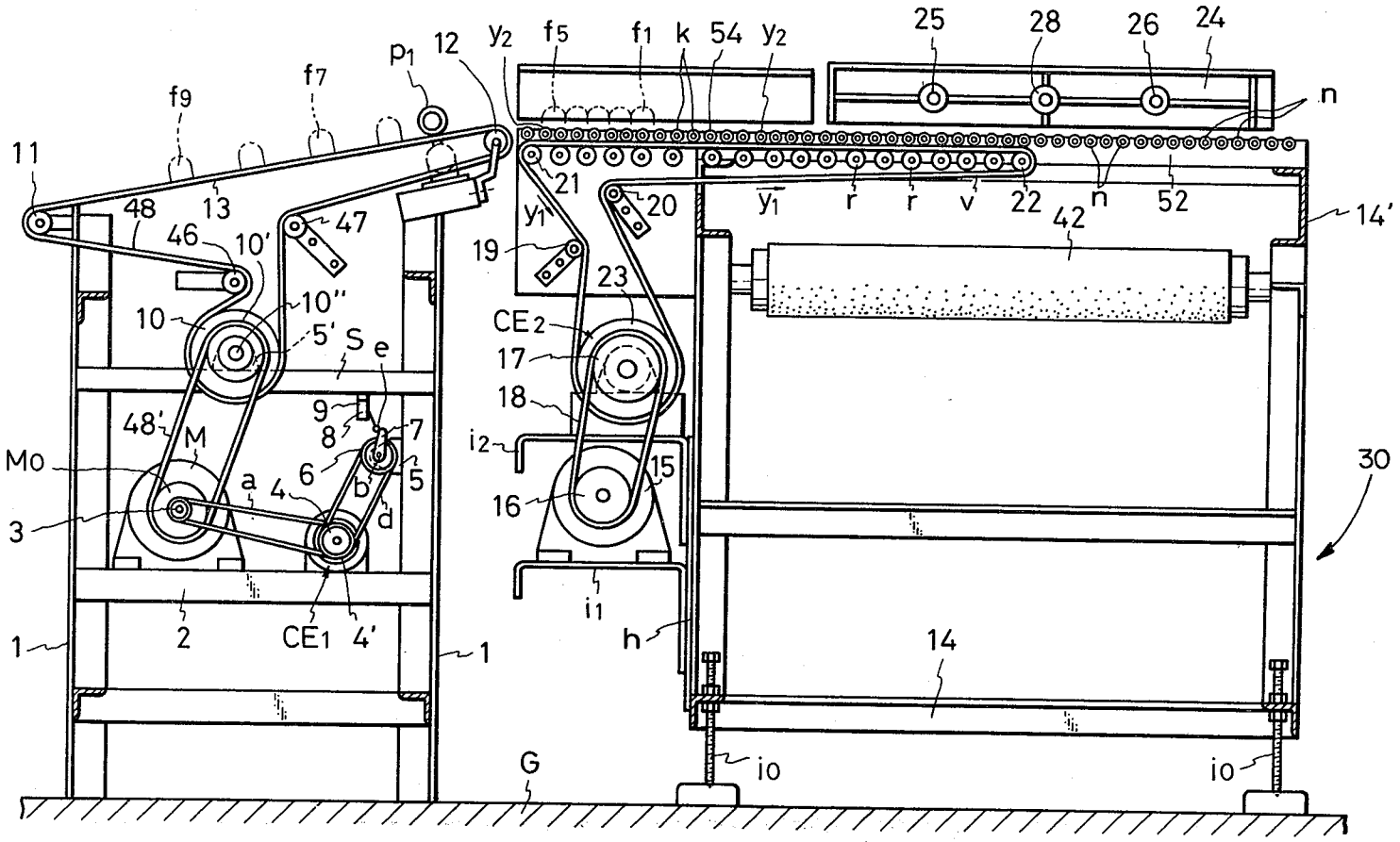
FIG. 5 is a vertical section taken along the line V—V of FIG. 3.
Figure 6:
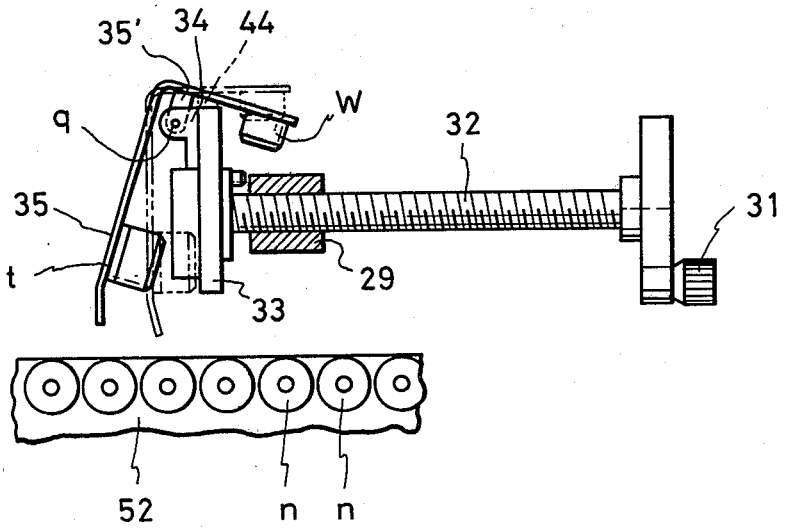
FIG. 6 is an enlarged side view showing a feeler portion.

Conveyor frame 30 (FIG. 5) is composed of horizontal members 14, vertical members h and longitudinal members 14'. Conveyor frame 30 is mounted on floor G by adjusting screwbolts i0. The clutch and brake unit $CE_2$ is set on support member i2, and motor 15 is set on support member i1. Both are fitted to vertical member h. Endless belt 18 is passed around driving pulley 16 fitted on the shaft of motor 15 and driven pulley 17 fitted on the driven shaft of the clutch and brake unit $CE_2$. An endless belt V passes around drive roller 23 connected to the clutch and brake unit by a coupling (j) (FIG. 4) and tension rollers 19, 20 (FIG. 5) guide rollers 21, 22 and idle rollers r. Rollers k contact belt V and are driven by friction. Idle rollers r help to increase the friction between rollers k and belt V. Free rollers n are arranged to the right of rollers k (FIG. 5). Guide rollers 21, 22 and idle rollers r are supported on support members 53 (FIG. 4) while rollers k and free rollers (n) are supported on frame 52.

Figure 3:
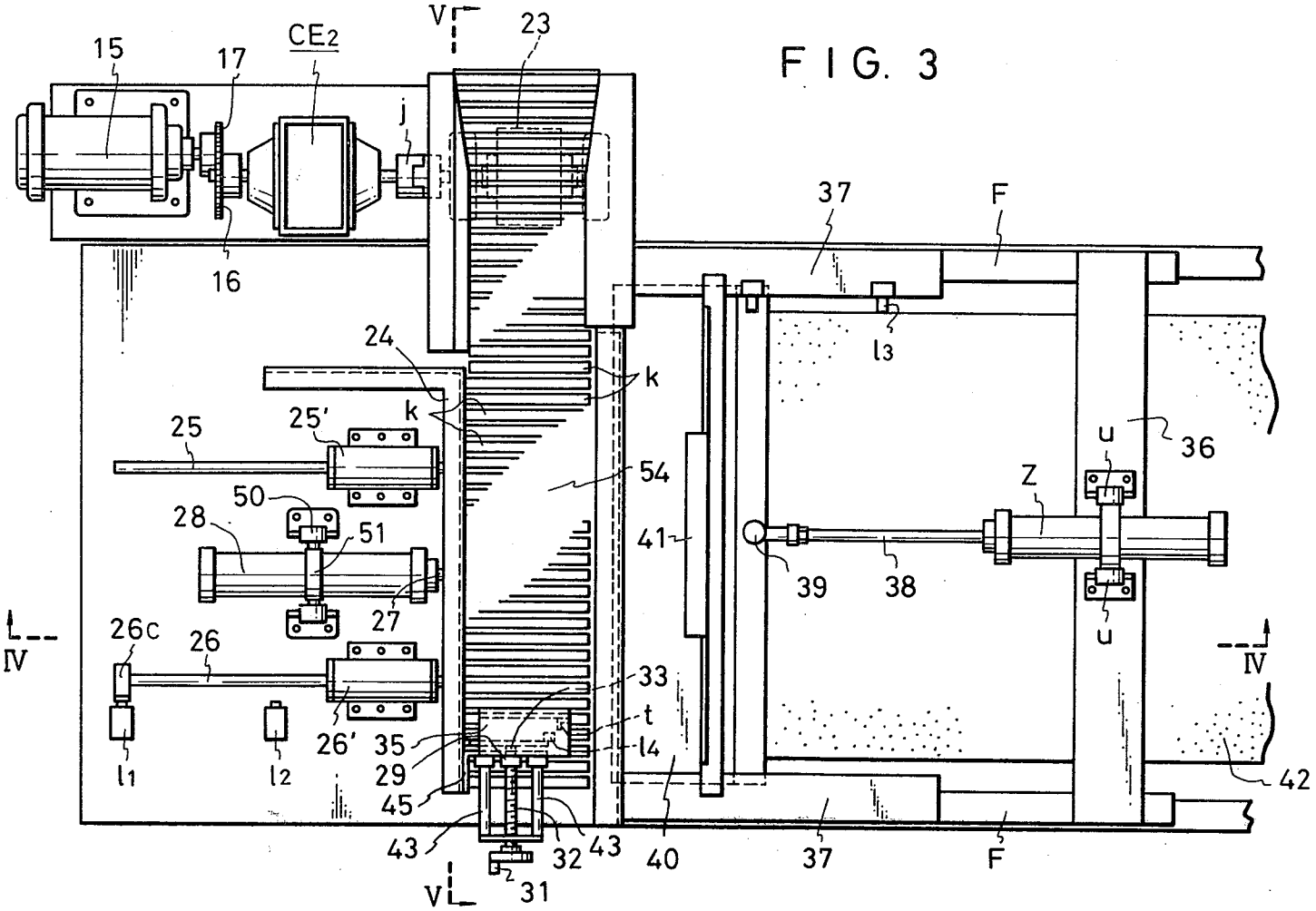
FIG. 3 is a more detailed plan view of the apparatus needed for the operation of FIG. 1.
Figure 7:
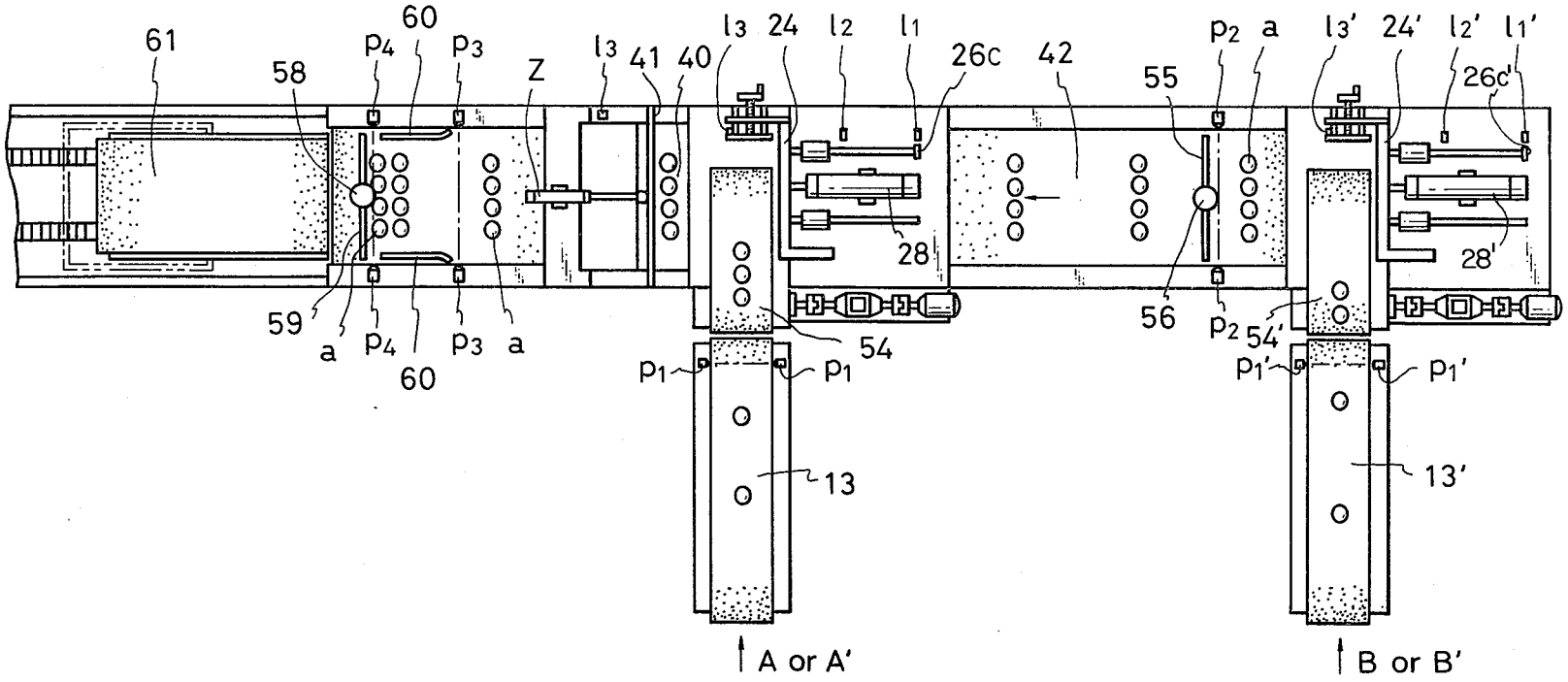
FIG. 7 is a general plan view of a grouping system with two grouping devices.

The conveyor comprised of the rollers k is named grouping conveyor 54. Pusher 24 normally arranged at one side of grouping conveyor 54 has guide bars 25, 26 (FIG. 3). An end of piston rod 27 also is connected to pusher 24. A piston (not shown) fixed to the piston rod 27 is moved by compressed air pressure or hydraulic pressure in cylinder 28 which is pivoted on bracket 49 by pin 51 and bearing 50 (FIG. 4). Guide bars 25, 26 are guided by and slide in slide bearings (not shown) in bearing housings 25', 26', so that the pusher 24 is moved linearly. Dog 26C mounted on an end of a guide bar 26 approaches proximity switches $l_1$, $l_2$ during the stroke of pusher 24. When the dog 26C closes proximity switch $l_1$ and dog t (later described) closes proximity switch $l_4$ (later described, piston rod 27 and pusher 24 move forward (to the right in FIG. 3), stopping at the end of the stroke beyond grouping conveyor 54, and at that time dog 26C closes proximity switch $l_2$. Immediately upon closing proximity switch $l_2$ piston rod 27 retracts and pusher 24 is moved backward (to the left in FIG. 3). Adjustable screw 32 with handle 31 (FIG. 6) is screwed in a female screw of bracket 29 fitted to one end of pusher 24, and is fitted to a stopper 33 rotatably and not separably. Feeler 35 has arm 35' pivoted to stopper 33 by pin q, and has a dog t, and counter-balance weight W. When the feeler 35 is pushed by the first article of the group and is in the indicated position as shown by the chain line (in FIG. 6), the dog t closes proximity switch $l_4$ mounted on the stopper 33, thereby moving pusher 24 forward (rightward in FIG. 3). Further, a pair of guide rods 43 fitted to stopper 33 are disposed on both sides of screw 32, and extend through slide bearings 45 of bracket 29. Thus stopper 33 can be adjust linearly. A piece of sponge rubber 44 mounted on the upper side of stopper 33 acts as a shock absorber to feeler 35. The adjustable stopping device is provided to put the articles grouped symmetrically in width along the center line of conveyor 42 in case articles of various sorts and/or different sizes must be grouped by the same grouping equipment (FIG. 3). Shuttle plate 40 is arranged at the right side (in FIG. 3) of grouping conveyor 54, is jointed universally to piston rod 38 by ball joint 39, and slides along sliding guides 37 by stroke movement of piston rod 38. A piston (not shown) fitted to the piston rod 38 is moved by compressed air pressure or hydraulic pressure in a cylinder Z which is pivoted on bracket U. The bracket U is bolted on plate 36 which is mounted on frames F. The frames F are mounted on the outside of the frame of conveyor 42 and on the counter side of pusher 24 for grouping conveyor 54. Stopper plate 41 is fixed on sliding guide 37 for shuttle plate 40. When the group of articles is pushed by the pusher 24 onto the shuttle plate 40, an electric signal is sent from the driving device (later described) of conveyor 42 to order dropping the group of articles of predetermined pitch on conveyor belt 42 and to allow the group from the other grouping device to keep enough space between each other for successive operations. Shuttle plate 40 slides rapidly to the right (FIG. 3) with the group thereon until the group of articles is stopped by the stopper plate 41 and dropped onto conveyor belt 42 in a lateral line. In FIG. 3, a proximity switch $p_3$ is mounted on the side of the sliding guide 37, so that when the slide shuttle plate 40 moves rightwards and a dog (not shown) fixed on the shuttle plate 40 closes the proximity switch $p_3$, slide plate 40 moves leftwardly immediately. In FIG. 7, feeding conveyor 13', grouping conveyor 54' and pusher 24' are a grouping device for articles from conveyor B or wrapping machine B'. Feeding conveyor 13, grouping conveyor 54, and pusher 24 are a grouping device for articles from grouping conveyor 54, and pusher 24 are a grouping device for articles from conveyor A or wrapping machine A'. Stopper plate 55 is mounted on the conveyor 42, and is lifted by air cylinder 56 to let the group of articles pass through when the said group of articles pushed by pusher 24' to conveyor belt 42 reaches the front of stopper plate 55. The articles at stopper plate 55 shield the light beam of photocell $p_2$, $p_2$ mounted on both outer sides of conveyor 42. An electrical signal is sent from limit switch $l_s$ in the driving device (later described) of the conveyor 42. The electrical signals are sent at predetermined intervals so that the laterally lined group of articles are conveyed with given spaces between each successive group. Of course, the number of times the electric signal is sent exceeds the number of times the group of articles is pushed. When the group of articles passes through under the stopper plate 55 and photocell $p_2$, $p_2$ is unshielded, stopper plate 55 drops.

The conveyor 42 is driven by the driving pulley 65 through the geared motor 64 and chain 67. The geared motor 64 drives a common camshaft 62' on which cams 62, 63 are fitted through the chain 66. Limit switches $l_5$, $l_6$ are arranged to switch by a press of the convex part of cams 62, 63 each. Whenever the limit switch $l_5$ acts, as above-mentioned, an electric signal is sent at a preset interval to raise the stopper plate 55 and to convey the group of articles stopped in front of the stopper plate 55. Whenever the limit switch $l_6$ acts, an electric signal is sent at the same interval as above-mentioned and at a different time to pull back the shuttle plate 40 quickly and to drop the group of articles on the said shuttle plate onto the conveyor 42. By selecting a suitable position of the convex part of cam 62, 63, it is possible to move forward a line of grouped articles fed from the grouping conveyor 54' and a line of grouped articles fed from the grouping conveyor 54' at regular intervals. Also, a space between lines of each grouped articles can be freely set by the ratio of r.p.m. of the driving pulley 65 and that of the camshaft 62' according to the diameter of the driving pulley 65.

The conveyor 42 at its delivery end is equipped with a stopper plate 59 which is moved up and down by the cylinder 58 and a photocell $p_4$, $p_4$ to recognize the existence of grouped articles in front of the said stopper plate 59. The photocell lets the said stopper plate 59 lower when the grouped articles pass through under the stopper plate 59 after the stopper plate 59 has gone up. The conveyor 42 is also equipped with a photocell $p_3$, $p_3$ upstream of the photocell $p_4$, $p_4$ to count the number of lines of grouped articles conveyed on the conveyor 42 and to gather those lines of grouped articles for making a secondary group. The conveyor 42 is also equipped with sideguides 60.

Figure 8:
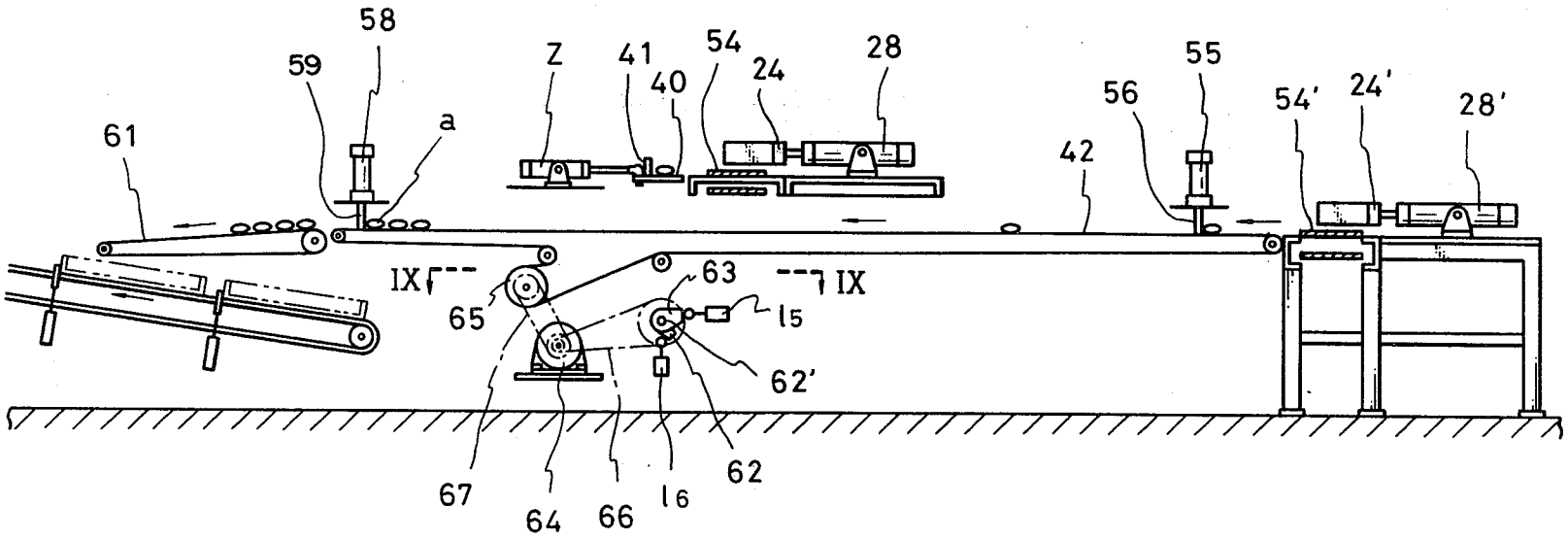
FIG. 8 is an elevational view of the grouping system shown in FIG. 7.
Figure 10:
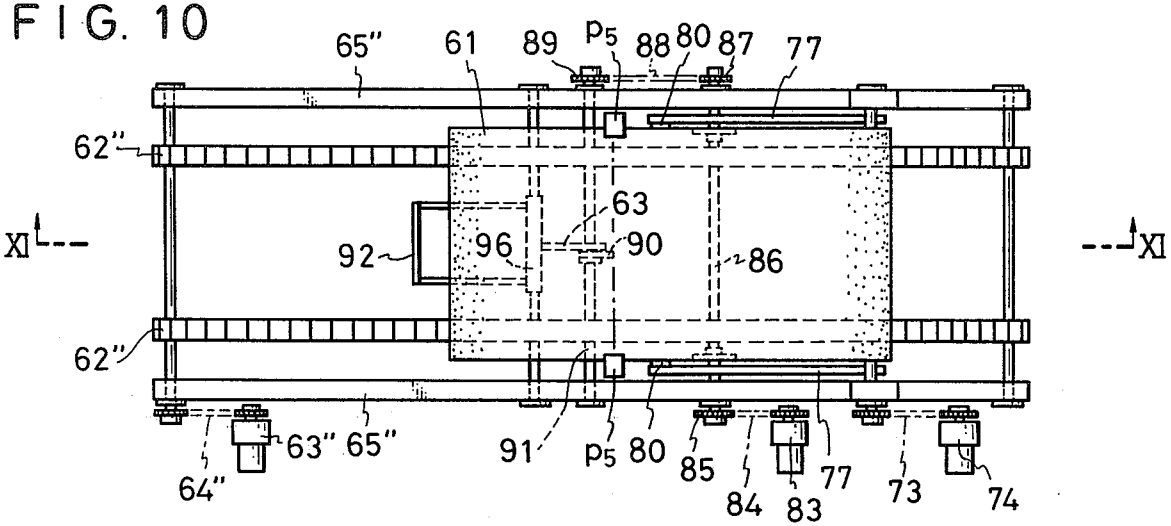
FIG. 10 is a plan view of tray loader including the loader conveyor 61 in FIG. 8.
Figure 11:
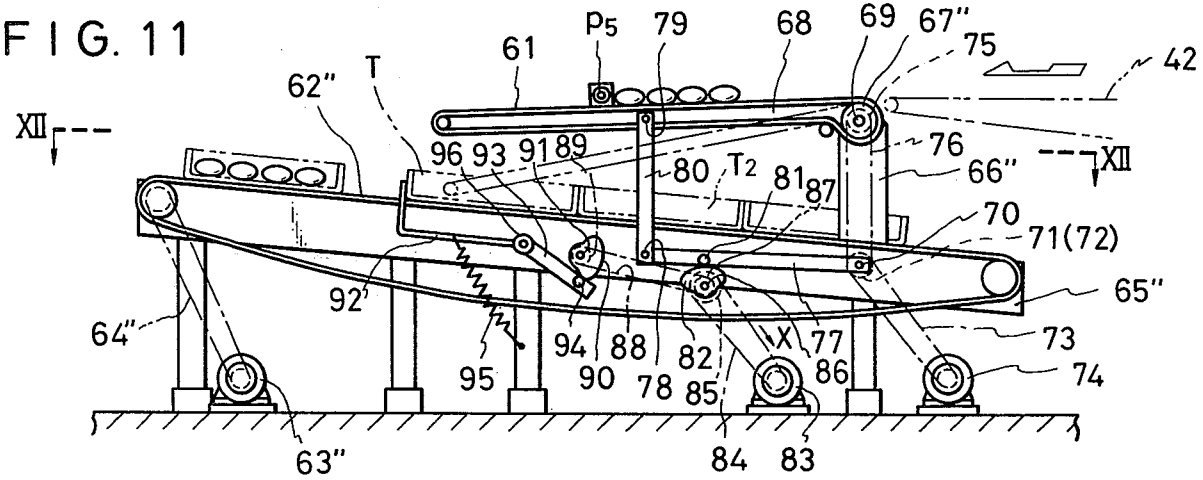
FIG. 11 is a sectional view taken along the line XI—XI of FIG. 10.
Figure 12:
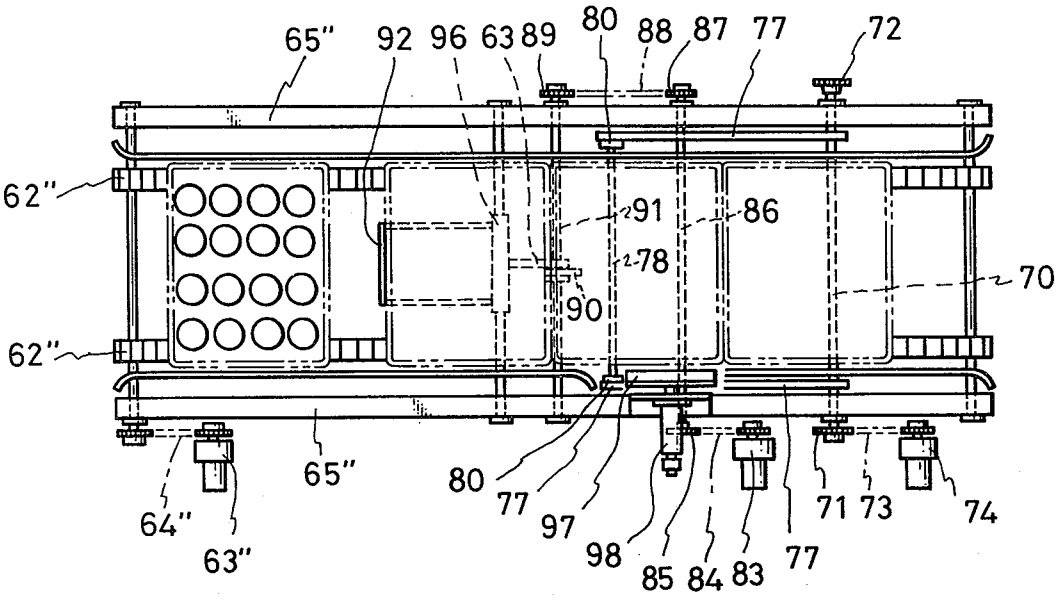
FIG. 12 is a view taken along the line XII—XII of FIG. 11.
Figure 13:
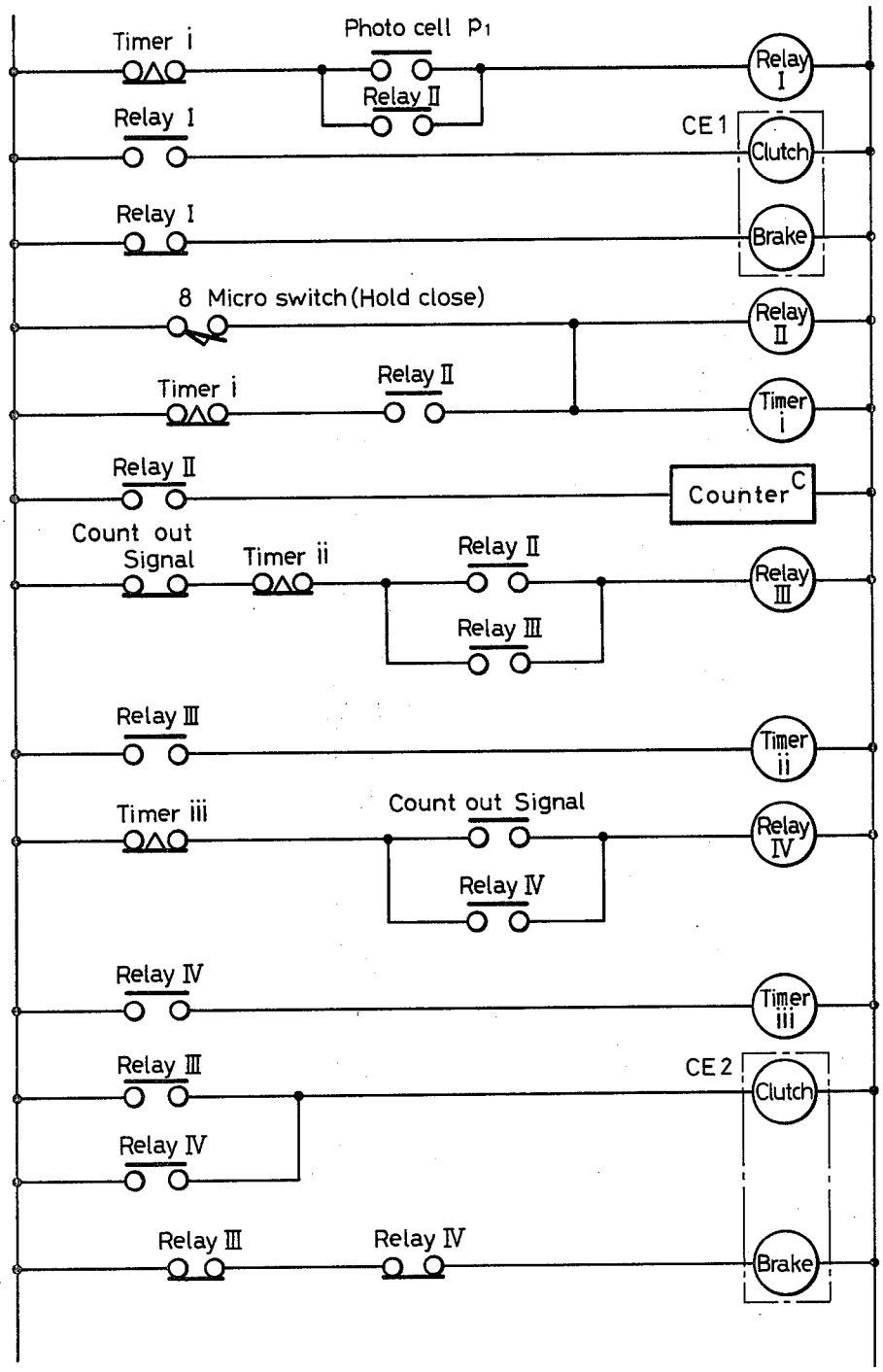
FIG. 13 is a sequential diagram showing control and motion of the grouping device shown in FIG. 4.
Figure 14:
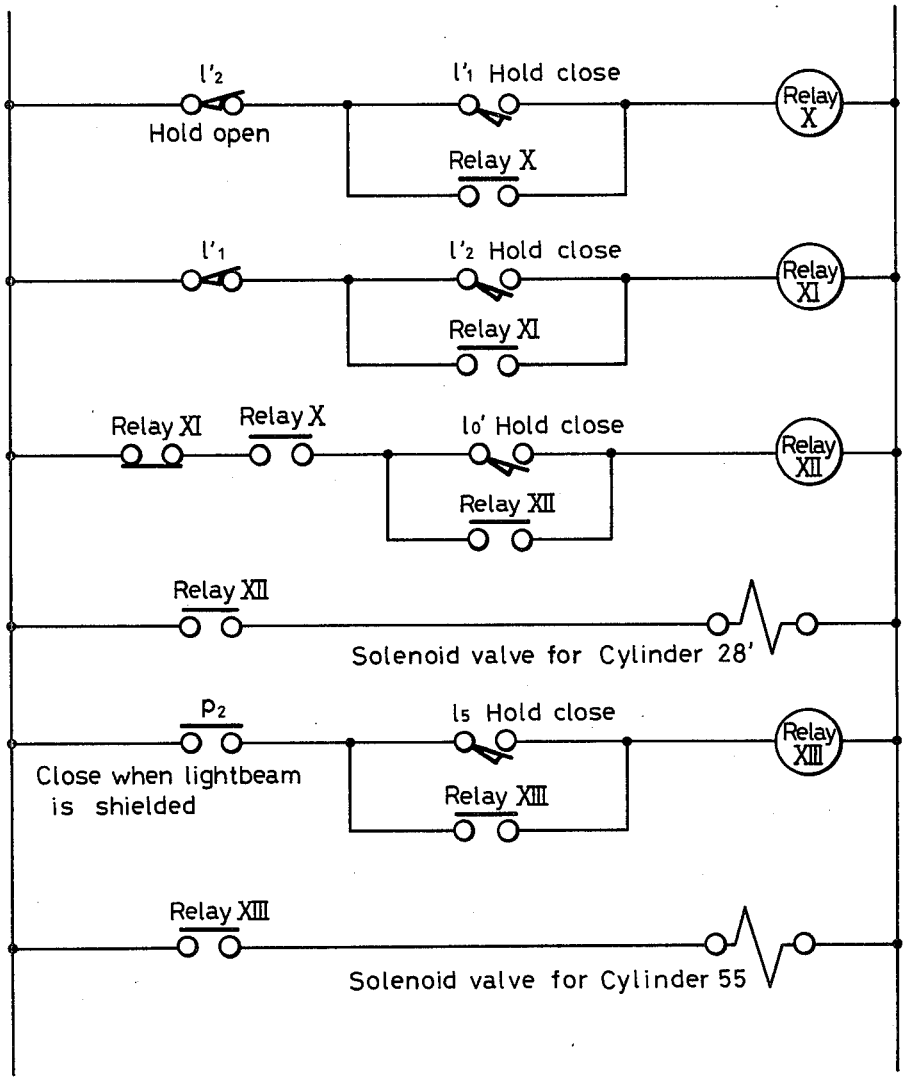
FIG. 14 is a sequential diagram showing control and motion in FIG. 3.
Figure 15:
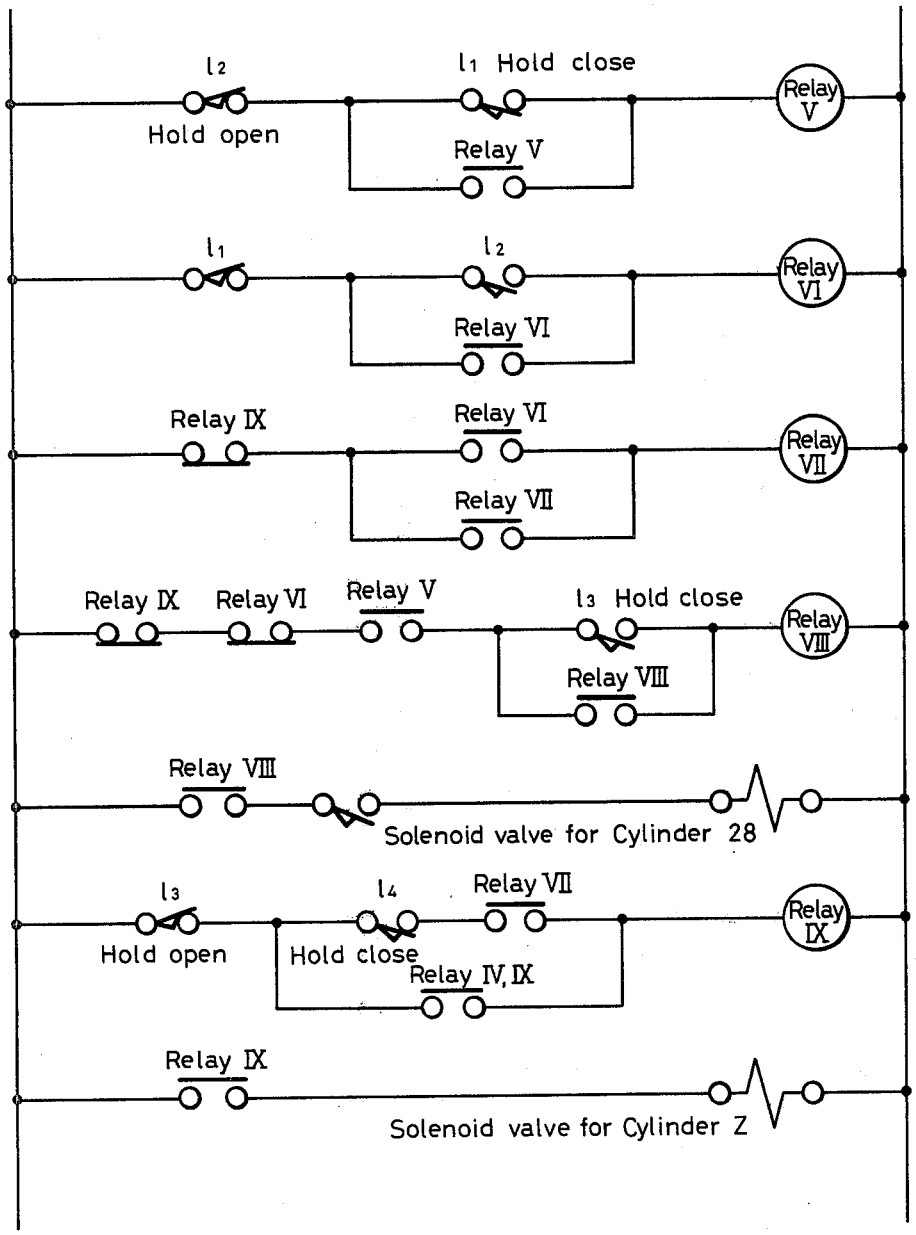
FIG. 15 is a sequential diagram showing control and motion of the right hand grouping device in FIG. 7.
Figure 16:
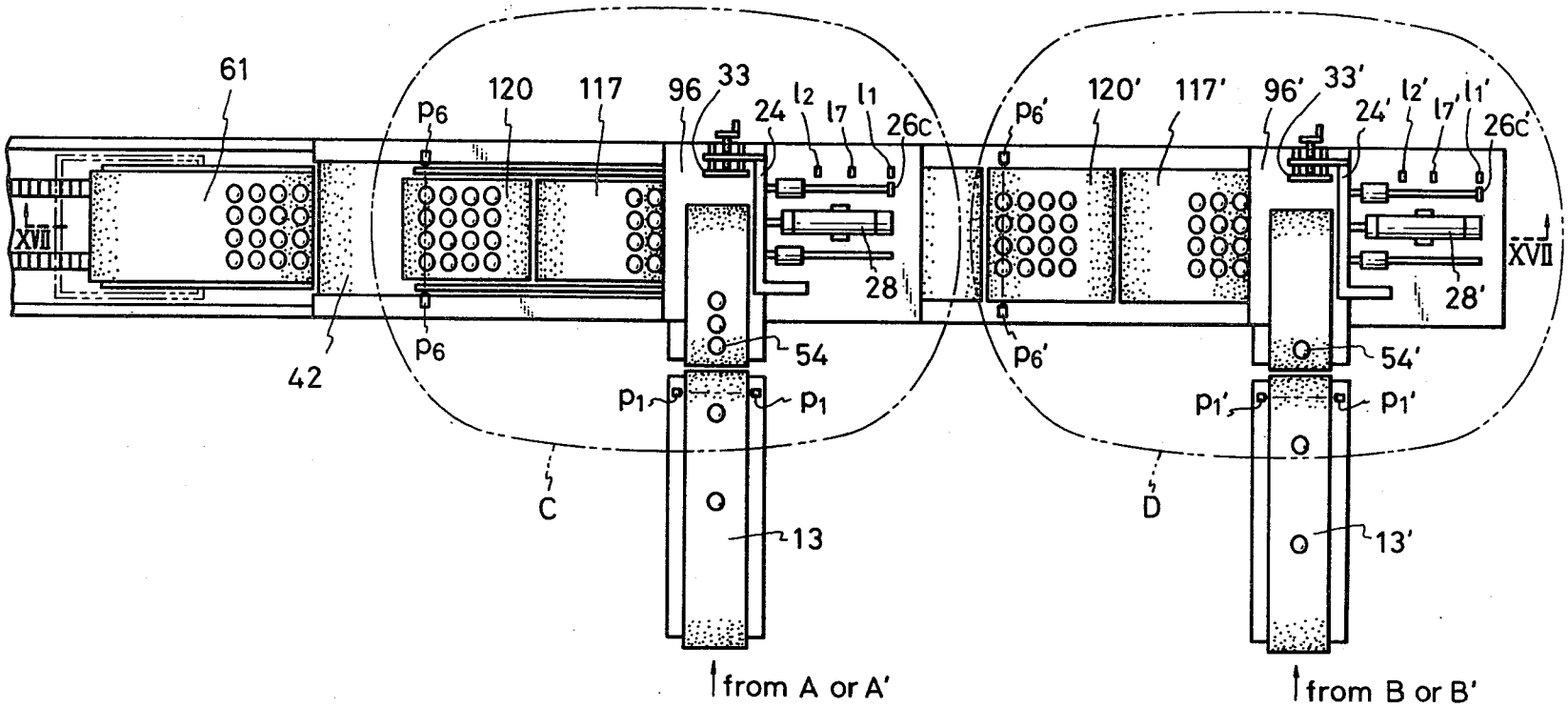
FIG. 16 is a general plan view of an another embodiment of a grouping system with two grouping devices.
Figure 17:
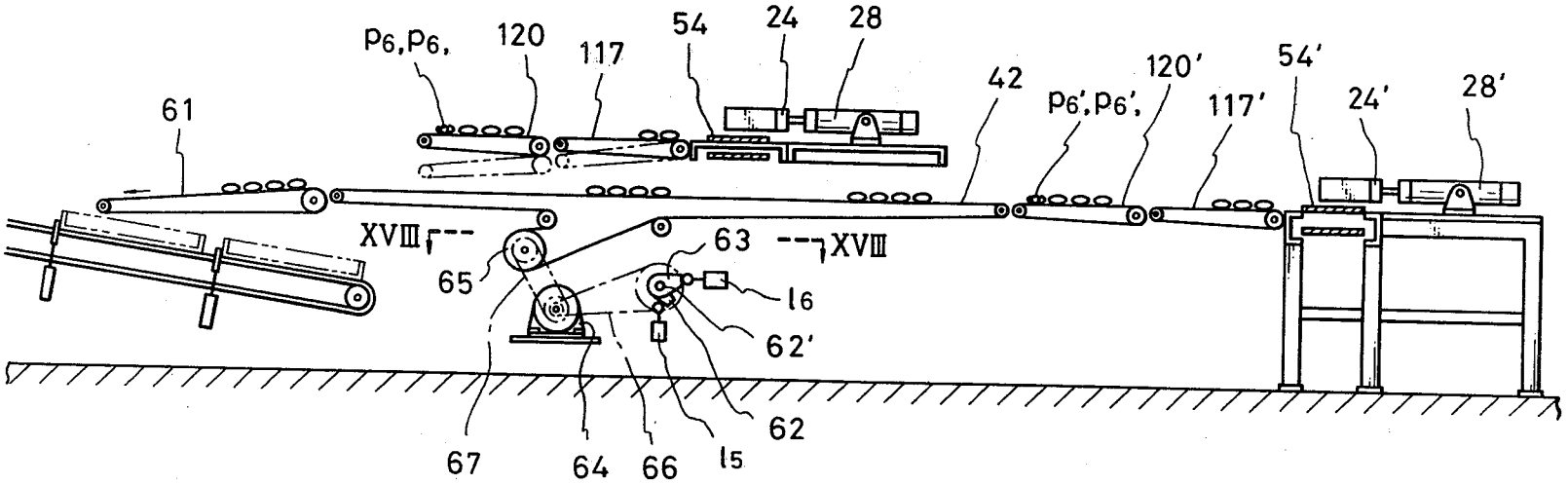
FIG. 17 is an elevational view of the grouping system shown in FIG. 16.
Figure 18:
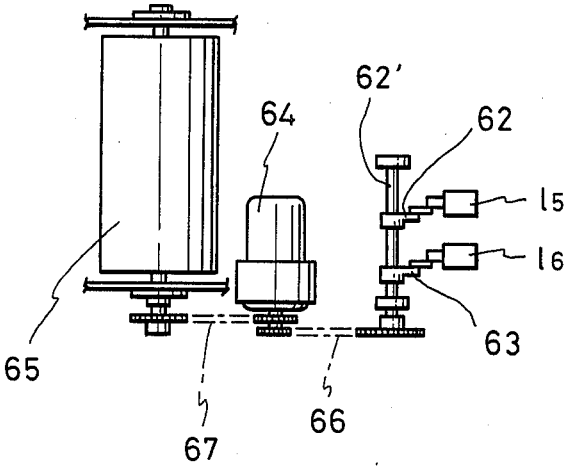
FIG. 18 is a driving device for the conveyor 42 of FIG. 17 taken in section along the line XVIII—XVIII of FIG. 17.
Figure 19:
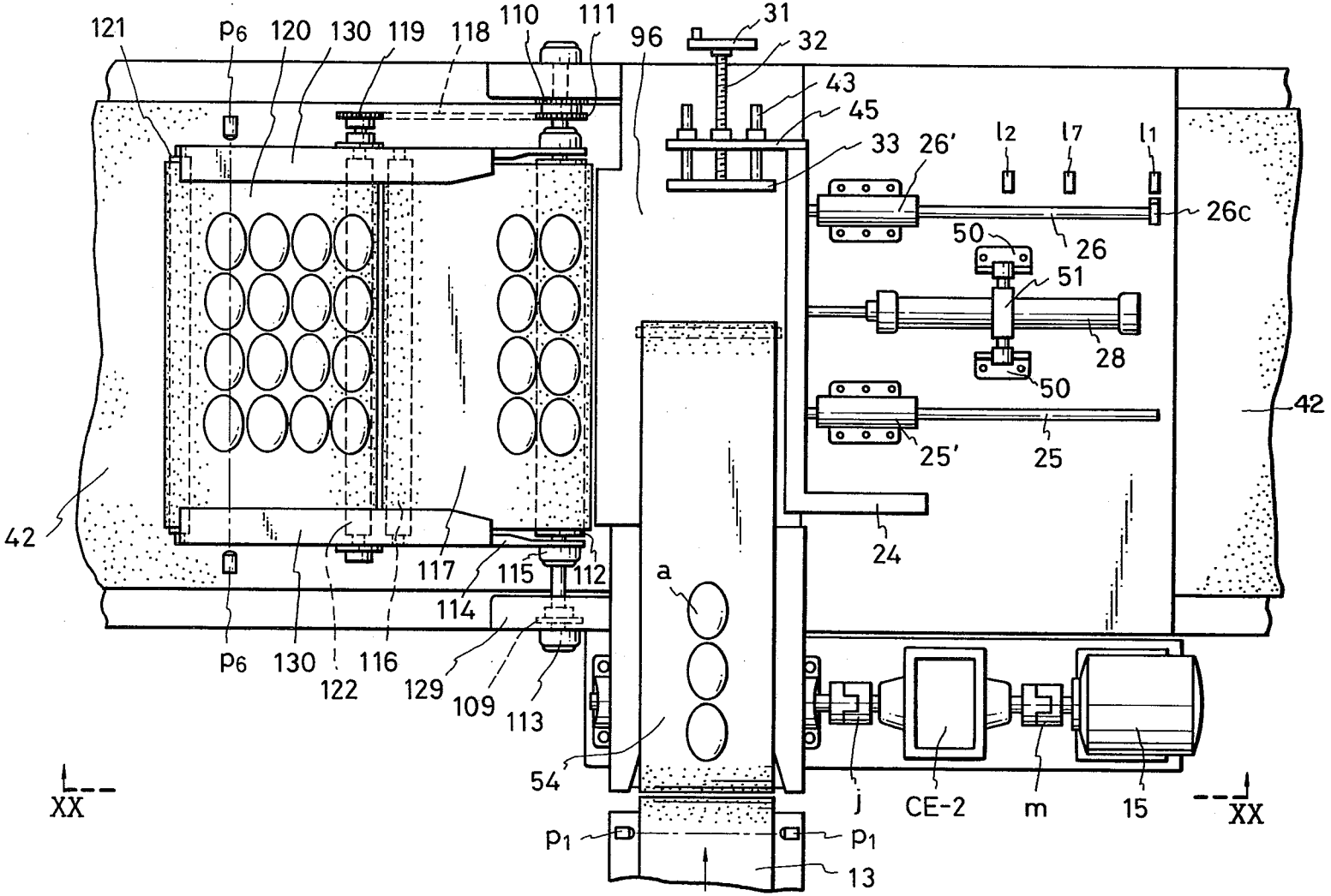
FIG. 19 is a more detailed plan view of part "C" in FIG. 16.

The loading conveyor 61 is arranged as shown in FIG. 7 and FIG. 8 at the delivery end of the conveyor 42. FIGS. 10, 11 and 12 show the tray loader in detail.

Conveyor 62" conveys trays and is driven by the geared motor 63" through the chain 64".

Frame 65" supports the conveyor 62". Frame 65" carries an intermediate shaft fitted 70 supported on bearings (not shown) which are mounted on both sides of the conveyor 62. Shaft 70 is used to drive the loading conveyor 61.

A bracket 66" is fitted vertically on both sides of the conveyor frames 65" and holds the conveyor 61.

A driving pulley 67 for driving the conveyor 61 is held by bearings (not shown) on the brackets 66".

The geared motor 74 drives a sprocket 71 fitted on one end of the intermediate shaft 70 through the chain 73. Also a sprocket 72 is fitted on the other end of the intermediate shaft 70 to drive a sprocket 75 fixed on the said driving pulley 67" through chain 76.

Frame 68 of the conveyor 61 has bearings (not shown) on its one end to mount the shaft of the said driving pulley 67" and moves like a hinge.

Two arms 77 are revolvably jointed with the intermediate shaft 70 at each one's end and also jointed with pin 78 fixed at each of their other ends. Two connecting arms 80 are revolvably jointed with the pin 78 at each one's end and also revolvably jointed with the pins 79 fixed on both sides of the conveyor frame 68 at each of their other ends.

Two rollers 81 fit rotatably on the middle part of arms 77 and contact cam 82 by which the connecting arms 80 support the conveyor frame 68.

The geared motor 83 having brakes through the chain 84 drives the sprocket 85 fitted on one end of cam shaft 86 supported in bearings not shown mounted on both sides of the conveyor frame 65. Two cams 82 fitted on the cam shaft 86 turned fully once under the control of a limit switch and a dog fitted on the cam shaft (not shown) and stopped.

The sprocket 87 fitted on the other end of cam shaft 86 and the chain 88 transmit the power to the sprocket 89 fitted on another cam shaft 91 fitted rotatably on the conveyor frame 65. The sprocket 89 turns the cam 91 fitted on the cam shaft 90'.

The sprocket 87 and the sprocket 89 have the same number of teeth so that the cam 90 stops after one rotation.

The L shaped stopper 92 extends its up end usually above the travelling surface of the conveyor 62" and holds a tray T. The other end of stopper 92 is revolvably jointed with the shaft 91 fixed on the conveyor frame 65".

The pinned roller 94 on the arm 93 which is welded to a part of bearing housing 96 of the stopper 92 contacts cam 90. When the said roller 94 contacts the convex part of the cam 90, the stopper 92 uses above the tray travelling surface and performs its function. Also when the roller 94 contacts the concave part of the cam 90, the said stopper 92 lowers by the action of the spring 95 and releases a tray.

A couple of photocells $p_5$, $p_5$ is mounted on both sides of the conveyor 61. When the photo cells recognize the head of grouped articles fed from the conveyor 42 to the conveyor 61, the geared motor 83 having a brake rotates, and the chain 84 travels in the direction of the arrow to rotate cams 82 and 90. Before the head of the grouped articles arrives at the delivery end of conveyor 61, the roller 81 contacts the concave part of cam 82 being rotated, and the delivery end of conveyor 61 is lowered into a tray T which is waiting on the conveyor 62" and stops by the stopper 92. It is shown by the chain line in FIG. 11.

Also, when the head of the grouped articles is conveyed and reaches the delivery end of conveyor 61 and touches the front wall of tray T, the roller 94 contacts the concave part of cam 90 being rotated, and the stopper 92 is pivoted downwardly, and the tray travels on the conveyor 62.

The speeds of the conveyor 62" and conveyor 61 are almost the same so that the grouped articles are smoothly loaded into tray T without disorder of the group shapes or an interference of unnecessary pressure.

Figure 9:
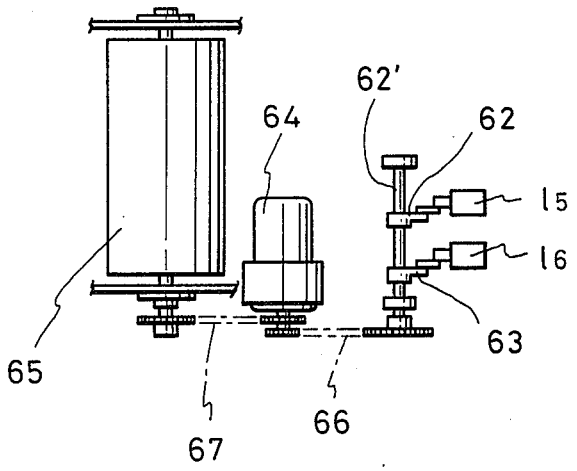
FIG. 9 is a driving device for the conveyor 42 of FIG. 8, taken section along the line IX—IX of FIG. 8.

As tray T moves ahead and before its rear part touches the delivery end of the conveyor 68, rotation of the cam 82 causes the roller 81 and the arm 80 to be raised thereby raising the conveyor 68 and returning it to its normal position as shown in FIG. 9.

The cam 90 rotates more and after the rear part of the tray has passed over the stopper 92 the convex part of cam 90 presses down the roller 94 to raise the stopper above the tray travelling surface, to await the next tray.

In this case, the geared motor 83 having a brake pauses by the action of the limit switch (not shown) so that the cams 82 and 90 also pause as shown in FIG. 11.

The stopper 97 is provided with a hydraulic cylinder mounted on the side of conveyor frame 65. The said cylinder pushes toward the guide 121 mounted on the conveyor frame 65" to hold the second tray $T_2$. Also, after the stopper 92 has returned to its normal position, the guide 121 becomes free and makes tray $T_2$ travel to the stopper 92.

Therefore, this apparatus can carry out a smooth loading operation, if delivered groups on said conveyor 42 are conveyed at the same or mere time pitch as or than net required time for loading an article group into a tray plus feeding next following an empty tray underneath conveyor 61".

In operation, when articles $f_1$, $f_2$, $f_3$. . . $f_9$, $f_{10}$. . . are conveyed on the feeding conveyor 13 from the wrapping machine or the conveyor A at some interval, the first article $f_1$ passes through the position of photocell $p_1$, $p_1$ and shields the light beam, the relay I is energized the clutch is engaged the brake is release in the clutch and brake unit $CE_1$, the cam 7 is rotated and presses actuator e and a contact of the microswitch 8 is closed, which energizes relay II and time (i). Time out signal of the timer (i) de-energizes the relay II thus stopping the cam 7 at the place where the summit of the cam 7 is over the actuator e. The speed of the feeding conveyor is such as to have the article entirely pass through and also the light beam of the photocell $p_1$, $p_1$ recover from shielding before the timer (i) sends a time-out signal. Therefore, even if foreign materials adhere to a transparent part of a film, for example, polyethylene, wrapped articles or letters printed on said film shield the light beam and send noise signals, relay I is energized, clutch-brake unit $CE_1$ operates and cam 7 is rotated momentarily to the extent that the summit of cam 7 doesn't strike the actuator (e). Therefore, there is no miscount. When the article passes through the photocell $p_1$, $p_1$ , the timer (i) sends a time-out signal, relay I is de-energized, thus releasing the clutch and engaging the brake in the clutch and brake unit $CE_1$. When the hold close contact of the relay II closes, the number of articles which passed through between the photocell $p_1$, $p_1$ is counted by the counter c, and relay III is energized and self held. The contact of relay III held causes engagement of the clutch and releases the brake in the clutch and brake unit $CE_2$ and energizes timer ii. It makes pulley 23 rotate through the coupling j, the belt v to travel in the direction as indicated by the arrow $Y_1$ and consequently to rotate the rollers k in the direction as indicated by the arrow $Y_2$. Article $f_1$ which has reached already the feed end of grouping coveyor 54 is conveyed toward stopper 33. Time out signal of timer ii releases relay III and the clutch and engages the brake in the clutch and brake unit $CE_2$, making grouping conveyor 54 stop. Timer ii is so preset as to advance and stop the article $f_1$ which has reached the feed end of grouping conveyor 54 at the distance of about a longitudinal length of the article along the conveyor. When the second article $f_2$ passes through between the photocell $p_1$, $p_1$ and reaches the feed end of grouping conveyor 54, the number of the article is counted and grouping conveyor 54 is driven for a time while the article advances a distance of about its longitudinal length along the conveyor and stops. Thus article $f_2$ moves close to the rear of article $f_1$, and contacts it on the grouping conveyor 54. Whenever the third article $f_3$, the fourth article $f_4$ fifth article $f_5$ pass through between the photocell $p_1$, $p_1$ and reach the feed end of grouping conveyor 54 one after another, the number of the article is counted and grouping conveyor 54 is driven for the predetermined time described before and is stopped. Thus five articles $f_1$, $f_2$, $f_3$, $f_4$, $f_5$ are grouped on the grouping conveyor 54 as in FIG 1. For example, in the case of a six article grouping, a preset number of counter C is six. When the sixth article $f_6$ passes through between the photocell $p_1$, $p_1$ the cam 7 is rotated and stopped, the sixth signal is sent to the counter C, contact of the counter is closed to make a count-out signal and automatically returns to the first state. The counter-out signal energizes relay IV and makes it self held. Contact of the energized relay IV energizes, the timer iii, causes it to engage the clutch and release the brake in the clutch and brake unit $CE_2$, and drive the grouping conveyor 54. Timer iii is preset to convey the first article $f_1$ up to the stopper 33 and stop. Time out signal of timer iii releases relay IV and the clutch, engages the brake in the clutch and brake unit $CE_2$, and stops grouping conveyor 54. Thus, the sixth article $f_6$ which has reached already the feed end of the grouping conveyor 54 and is in contact with the rear of the fifth article $f_5$ is conveyed in one group with articles $f_1$, $f_2$, $f_3$, $f_4$, $f_5$ toward the stopper 33 till the group touches the feeler 35. If the article $f_7$ passes between the photocell $p_1$, $p_1$ and reaches the feed end of grouping conveyor 54 while the group of the articles $f_1$–$f_6$ is conveyed toward the stopper 33, the article $f_7$ is conveyed for relatively longer time than usual and the space between the article $f_7$ and the next article $f_8$ consequently is made to have more room. However, when the second group $f_7$, $f_8$ . . . $f_{12}$ is conveyed toward stopper 33 in one group, the article $f_7$ waits on the free roller n until the next article $f_8$ contacts it and slightly pushes it toward the feeler 35. When the group of the articles conveyed from the conveyor A or the wrapping machine A' , as in FIGS. 3, 4, 7, 8, reaches the stopper 33 and pushes the feeler 35 and the dog t to close proximity switch $l_3$, the pusher 24 pushes the group of the articles onto the shuttle plate 40 and immediately withdraws due to activation of proximity switch $l_2$. The shuttle plate 40 is slid rapidly by the electrical signal from the proximity switch $l_6$ and cam 62 which is arranged on the driving device of the conveyor 42 (later described) and is closed at a predetermined interval in order to drop the group of the articles at a predetermined pitch onto conveyor 42 between the groups of the articles from the grouping conveyor 54'. The group of articles moving on the shuttle plate 40 is stopped by the stopper plate 41 and dropped as a lateral group onto a fixed plate on conveyor 42 right under the shuttle plate 40. The shuttle plate 40 immediately retracts to its original position by a signal from the proximity switch $l_3$. The group of articles pushed by the pusher 24 onto the shuttle plate 40 is kept waiting thereon until reviewing the signal from proximity switch $l_6$. During said waiting, simultaneously the next group is placed on the grouping conveyor 54.

When the articles conveyed from the conveyor B or the wrapping machine B' and grouped on grouping conveyor 54' push the feeler 35' and close proximity switch $l_3'$ similarly as the articles conveyed from the conveyor A or the wrapping machine A', the pusher 24' pushes the said group of the articles to the conveyor belt 42 and immediately is retracted by proximity switch $l_2'$. The group of articles which is pushed onto conveyor belt 42, is conveyed on conveyor belt 42 until stopped by the stopper plate 55. The group in stopping at stopper plate 55 shields the light beam of photocell $p_2$, $p_2$. The interruption of the light beam causes the lifting of stopper plate 55 by air cylinder 56. The lifting of stopper 55 allows the waiting group of articles to pass on along conveyor 42. The interruption of the photocell $P_2$, $P_2$ and the electrical signal from the proximity switch $l_5$ and cam 63 which is arranged on the driving device of the conveyor 42 permits the chasing of stopper plate 55 at a predetermined interval in order to convey the group of the articles at predetermined pitch on the conveyor 42. During said waiting, simultaneously the next group is placed on the grouping conveyor.

When the group of articles passes through and the light beam of the photocell $p_2$, $p_2$ is unshielded, the pulled up stopper plate 55 is dropped. Thus, the groups of the articles from two grouping devices are conveyed on the conveyor 42 at the predetermined pitch, and are conveyed to a second group device. If the electric signal from proximity switches $l_5$ or $l_6$ is sent, and there is no group of the articles on the shuttle plate 40 or in front of the stopper plate 55 respectively, the shuttle plate 40 is not slid or the stopper plate is not raised, so that the said pitch of the group of articles become twice or three times or four times as much.

Groups of articles fed from the above-mentioned two grouping device travel on the conveyor 42, and when one of groups pass through between the photocells $p_3$, $p_3'$, it is counted by a counting unit (not shown), and it goes ahead more and is held at the position of the stopper plate 59. When the first group travels in front of the stopper plate 59, it shields the light beam of the photocell $p_4$, $p_4$ and an electric signal is sent. In the same manner, the next group is counted when it pass through between the photocells $p_3$, $p_3'$, and it is conveyed until it touches the rear of the first one. Repeating in the same manner, when a preset number of groups (for example: the fourth one) passes through the photocells $p_3$, $p_3'$, a counter-signal sent out, and the stopper plate 59 is lifted up by the cylinder 58 by the action of said electrical signal of the existance of these groups and a timer (not shown) after the lapse of the time in which the fourth one reaches the rear of the previous one releases these accumulated groups. Furthermore, as soon as these groups pass through the photocells $p_4$, $p_4'$, the said photocells are again unshielded, and the stopper plate 59 drops to await the next groups.

In this way, a finally formed group of groups to be loaded in a tray is completed. The final group of articles travels onto the loading conveyor 61 and is loaded in a tray by the above-mentioned loading device shown in FIG. 10–12.

Another embodiment will be described in detail hereafter by way of FIG. 16 to FIG. 22. (Note: Parts having the same motion as described in the above-mentioned embodiment are given the same number.)

As well as the above-mentioned embodiment, whenever articles supplied from a wrapping machine A or a conveyor A' to a feeding conveyor 13 pass through photocells $p_1$, $p_1$, a clutch-brake unit $CE_2$running in operation is intermittently operated by the geared motor 15 and coupling m, and further the driving pulley 23 is intermittently driven by the coupling j. By these inching motions, a belt conveyor, that is, grouping conveyor 54' intermittently is driven.

By this way, the said articles are formed as a row group.

The sliding plate 96 having the same work as the free roller n described in the above embodiment is adjacent to the delivery end of grouping conveyor 54.

As soon as a row of grouped articles is conveyed by the grouping conveyor 54 to the stopper 33 and stops there, the pusher 24 operates after receiving a stop signal and pushes the articles bodily onto the left side conveyor.

Figure 20:
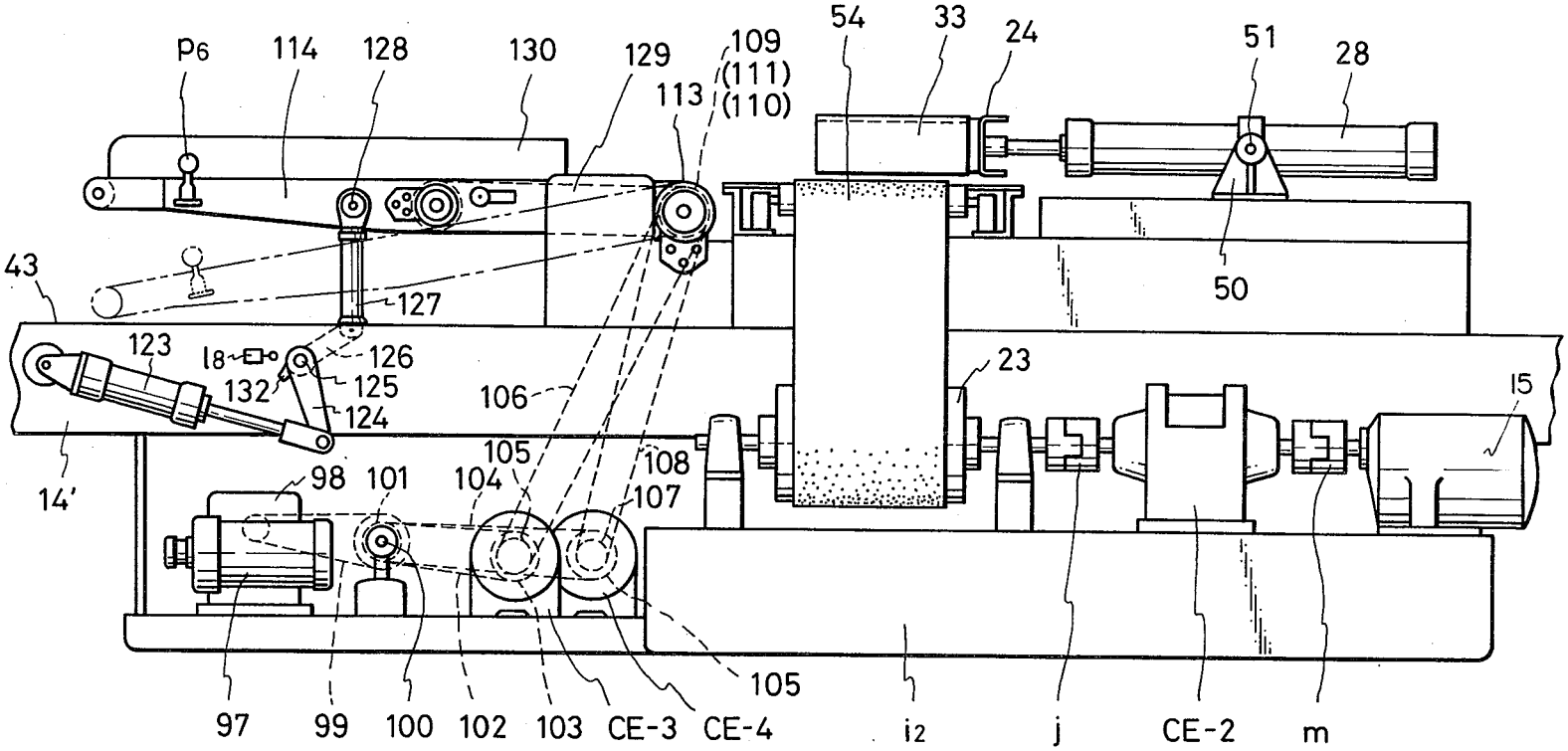
FIG. 20 is a elevational view of FIG. 19.

In FIG. 20, meanwhile, worm reducer 98 is driven by the motor 97 through a V-belt (not shown). An intermediate shaft 100 is driven by the worm reducer 98 through the chain 99 upon which two chain wheels 101 are fitted. Chain wheels 103, 105 respectively are mounted on the input shafts of the clutch-brake units $CE_3$, $CE_4$. Chains 102, 104 are mounted on 101, 103 and 105, 103 respectively and with this, the input shafts of $CE_3$, $CE_4$ are always driven.

The bearing 113 mounted on the bracket 129 which is fitted on the frame 14' of the conveyor 42 rotatably holds the driving roller 112 of the conveyor 117.

The conveyor frame 114 has the bearing housings 115 revolvably fitted on the shaft of the said driving roller 112 at both of its end.

At the one side of the conveyor frame 14', the hydraulic cylinder 123 is mounted in which one end is held with a pin fixed on the conveyor frame 14', and the other end of its piston rod is jointed with the one end of lever 124 with a pin.

The other end of the lever 124 is fixed on the end of the shaft 125 revolvably fitted on the conveyor frame 14'.

Two levers 126 are respectively fixed on the shaft 125 at their ends, and two connecting rods 127 are revolvably jointed at one of their ends to ends of the pin 128 fixed on both sides of the conveyor frame 114. The rods 127 are also jointed with the other end of the said levers 126 with a pin at their other end.

In this way, the conveyor frame 114 is in the horizontal position when the piston goes forward and slopes, when the piston goes back, pivoting about the shaft of the roller 112. The conveyor 117, 120 is ordinarily in the horizontal position.

On the shaft 125, a cam 132 is set, and its convex part pushes and activates the limit switch $l_8$ after the end of tilting.

By the chain wheel 107 fitted on the output shaft of the clutch brake unit $CE_4$, the chain wheel 109 fitted on the shaft of the driving roller 112 and the related chain 108, the driving roller 112 is rotated when the clutch is engaged and the brake is released in the clutch brake unit $CE_4$.

The chain wheels 110, 111 are assembled and revolvably fitted on the shaft of the driving roller 112. By the chain wheel 105 fitted on the output shaft of the clutch brake unit $CE_3$, the said chain wheel 110 and the related chain 106, and also by the said chain wheel 111, the chain wheel 119 fitted on the shaft of the driving roller 122 for the belt conveyor 122 and the related chain 118, the driving roller 122 is rotated when the clutch is engaged and brake is released in the clutch brake unit $CE_3$.

A delivery end roller 116 of the belt conveyor 117 is revolvably and adjustably mounted on the conveyor frame 114.

A delivery end roller 122 of the belt conveyor 120 also has the same function as a delivery end roller 116.

As before described, the said grouped articles travel to the stopper 33, and stop there and are pushed out to the belt conveyor 117 by the pusher 24. In the middle of this process, when the said articles are about to go onto the belt conveyor 117, the dog 26C closes the proximity switch $l_7$ and a signal generates. By the signal, the clutch is engaged and the brake is released in the clutch-brake unit $CE_4$. As described, the belt conveyor 117 rotates, and further by the timer, the clutch of the clutch-brake unit $CE_4$ releases, the brake of the unit engages and the conveyor 117 stops as far as the width of the article.

Repeating the above motion, when the appointed numbers are achieved, the secondary groups of articles are formed in plural lines abreast each other, another timer acts, and the belt conveyor 117 rotates until the secondary group transfers to the conveyor and then stops. When the appointed numbers are pushed by the pusher 24 and the belt conveyor 117 rotates, simultaneously the clutch of the clutch-brake unit $CE_3$ engages and the brake releases and the conveyor 120 rotates and receives the said secondary group belt conveyed by the conveyor 117. When the head of the secondary group shields the light beam of the photocells $p_6$, $p_6$, the clutch of the clutch-brake unit $CE_3$ releases and the brake engages the conveyor 120 stops and the secondary group stays on the conveyor 120 until a signal is sent for transferring the secondary group to the conveyor 42. During said conveying to photocell $p_6$, $p_6$ and said staying, simultaneously the next groups in a row are being made and the next secondary group in a plural line abreast is being made.

Figure 21:
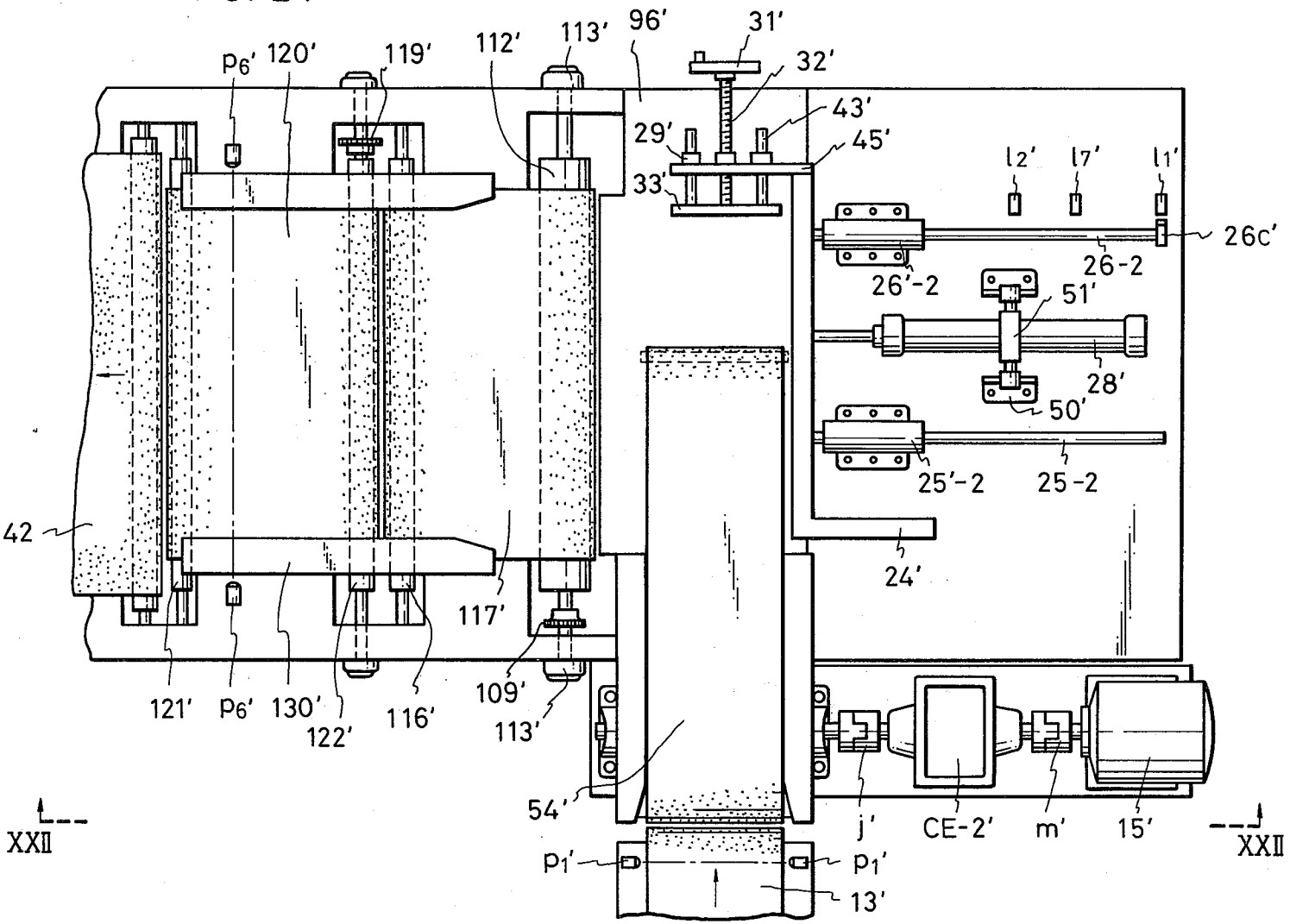
FIG. 21 is a more detailed plan view of part "D" in FIG. 16.
Figure 22:
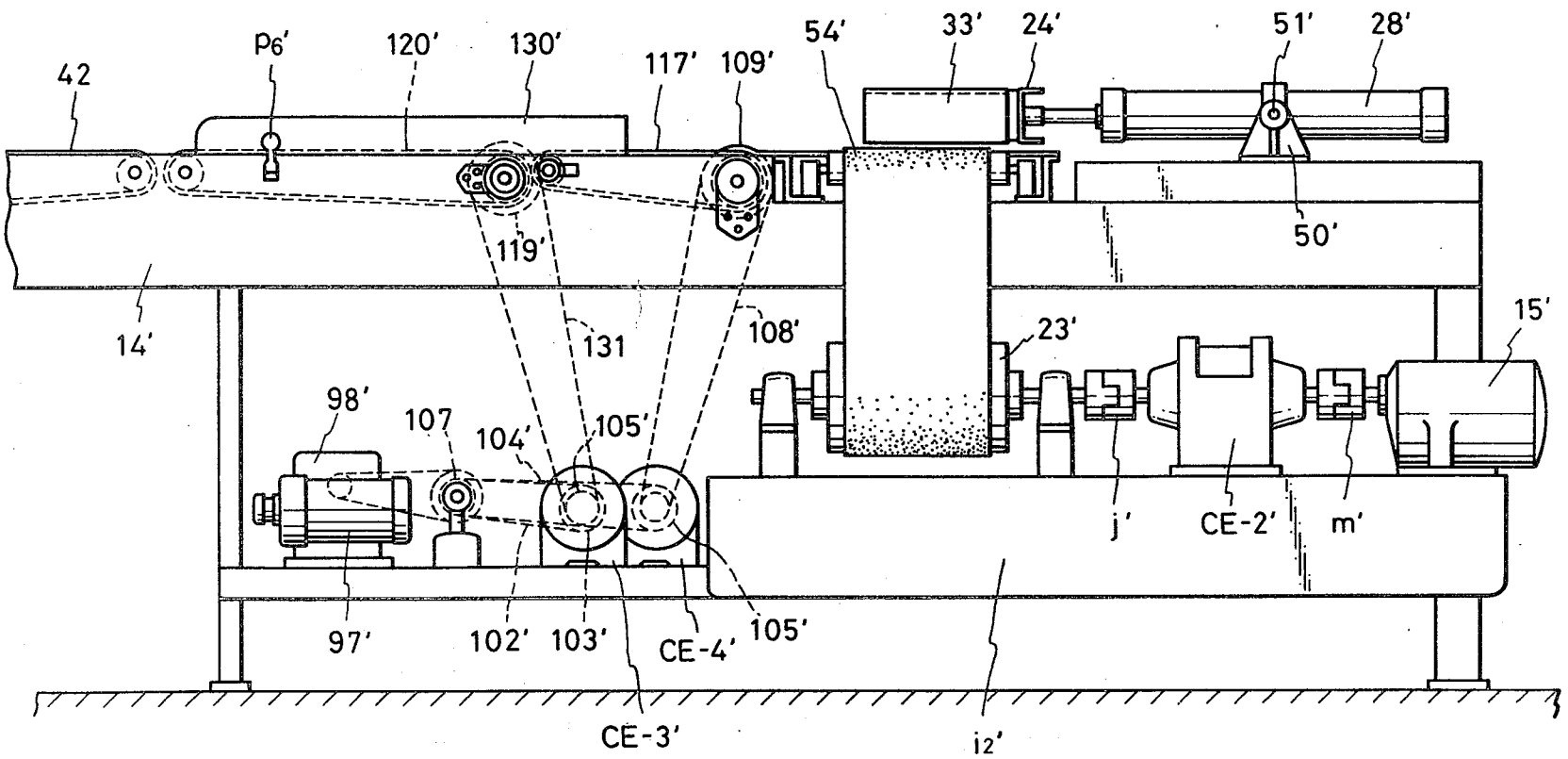
FIG. 22 is a elevational view of FIG. 21.

A grouping device for making a group of articles supplied from a wrapping machine B or conveyor B' as shown in FIG. 21 and FIG. 22 is almost the same as the system from the said wrapping machine A', conveyor A' so each number of parts which are same as before mentioned is marked with dash (') and the explanation is omitted. The points which are different from the above-mentioned grouping device are that the travelling surface of the conveyor 117' and 120' is the same level as that of the conveyor 42 so that a tilting mechanism for the conveyors 117' and 120' is not required, and that the driving roller 122' of the conveyor 120' is driven by the clutch-brake unit $CE_3'$ through the chain wheel 119' fitted with the shaft of the roller 122', the chain wheel 105' being fitted with the output shaft of the clutch-brake unit $CE_3'$ and the related chain 131.

Similarly to the said grouping device wrapping machine A or conveyor A', when each of articles travelling on the conveyor 13' passes through the photocells $p_1'$, $p_1$ and enters in a grouping conveyor, the grouping conveyor 54' inches as far as the length of an article, and repeating this motion, a group of articles is formed and travels to the stopper 33 and stops.

This group is pushed by the pusher 24' onto the belt conveyor 117', and on all such occasions, the conveyor 117' inches as far as the width of the articles, and by repeating this motion, the belt conveyor 117' gathers a group of article until becoming the desired numbers for the secondary group in plural lines abreast.

As soon as the secondary group is formed, it is conveyed to the conveyor 120', and when the head of the secondary group of articles shields the light beam of the photocells $p_6'$, $p_6'$, the conveyor 120' stops and then the said grouped articles stays on the conveyor 120' until a signal for a transfer to the conveyor 42 is sent as before described. During said conveying photocell $p_6'$, $p_6'$ and said staying, simultaneously the next groups in row are being made and the next secondary group in plural line abreast is being made.

The conveyor 42 is driven by the geared motor 64 through the chain 67 and the driving pulley 65. The geared motor 64 also drives a common camshaft 62' on which the cams 62, 63 fitted through the chain 66, and the limit switches $l_5$, $l_6$ are arranged each to be operated by the cams 62, 63.

Whenever the limit switch $l_5$ is actuated by pressing the convex part of the cam 62, a signal is sent at a preset interval to let the secondary group staying on the conveyor 120' travel to the conveyor 42 by action of the clutch-brake unit $CE_3'$ to be on in its clutch and to be off in its brake, and by the timer (not shown). When the secondary group is transferred to the conveyor 42, the clutch is released and the brake is engaged in the clutch-brake unit $CE_3'$, whereby the conveyor 120' stops.

Also, whenever the limit switch $l_6$ is activated by pressing the convex part of the cam 63, a signal is sent at a preset interval but different time to let the secondary group staying on the conveyor 120 travel to the conveyor 42. By this signal, the hydraulic cylinder 123 acts to move back its piston rod, whereby the conveyor frame 114 supporting the conveyor 117 and 120 tilts down, centering at the center of the driving roller 112, until the delivery end of the conveyor 120 almost touches with a travelling surface of the conveyor 42.

After tilting, the limit switch $l_8$ acts by pressing the cam 132 the clutch is engaged and the brake is released in the clutch-brake unit $CE_3$, whereby the conveyor 120 is driven and the waiting secondary group is transferred to the conveyor 42.

Further, by another timer (not shown), when the passing of the said secondary conveyor is over, the piston of the cylinder 123 pushes out and the conveyor frame 114 returns to its horizontal position. At the same time, the clutch is released and the brake is engaged in the clutch-brake unit $CE_3$, whereby the conveyor 120 stops.

According to the diameter of the driving roller of the conveyor 42 and by selecting the ratio of r.p.m. of the driving roller to the cam, it is possible to decide a timing to transfer each of the secondary groups from the conveyor 120 to the conveyor 42 and also a timing to transfer each of the secondary groups from the conveyor 120' to the conveyor 42. Further by adjusting the angle of the cams 62, 63 suitably a secondary group to be transferred from the conveyor 120 to the conveyor 42 can be transferred just in the middle place between the secondary groups which have been transferred from the conveyor 120' to the conveyor 42.

Therefore, it is possible to have each of the secondary group travel on the conveyor 42 at regular pitches or multiple of a pitch because when each of the secondary groups is not held on the conveyors 120, 120', discharging is called off so that an empty space is provided on the conveyor 42.

As explained in FIG. 10, a loading device is connected with the delivery end of the conveyor 42 and it loads each of the secondary groups transferred from the conveyor 42 at regular pitches or multiples of said pitch into a tray.

This embodiment is especially useful in case of loading each of different kinds of articles grouped by each of the grouping devices by the use of a single loading device. In this detailed explanation including figures, only 2 lines of feeding conveyors are shown, but additional numbers of lines of feeding conveyors "C" or "C'", "D" or "D'" and so on (not shown) can be installed if the total grouping rate does not exceed said loading capacity of this system.

What is claimed is:

1. Apparatus for conveying and gathering articles comprising a first grouping device including a feeding conveyor, a detector, a grouping conveyor, and a pusher; a second grouping device including a feeding conveyor, a detector, a grouping conveyor, a pusher and a shuttle plate arranged substantially parallel to each other; a cross conveyor; a limit switch and a transmitter for providing instructions to transfer or convey from said shuttle plate or other waiting devices to said cross conveyor by means of cams driven by a driving device of said cross conveyor, said second grouping device being disposed in the neighborhood of an outlet end of said cross conveyor arranged to cross said grouping conveyors.

2. Article grouping apparatus which comprises a feeding conveyor conveying articles to deliver received articles to a grouping conveyor;

a photo cell disposed at the delivery end of said feeding conveyor to generate a signal for counting the number of articles delivered and for intermittently driving said grouping conveyor through an electric relay;

a grouping conveyor adjoining said feeding conveyor, having a driving device including a motor and clutch brake unit, an article counting device, a stopper at the delivery end of said conveyor, said conveyor being driven and stopped intermittently by a signal from said photo cell to group articles in a row apart from following articles being driven until the foremost article of a lined group reaches said stopper after grouping, a pusher moveable across said grouping conveyor for pushing off said grouped articles, a shuttle plate disposed at one lateral side of said grouping conveyor for receiving pushed off grouped articles;

a cross-conveyor disposed below said grouping conveyor and said shuttle plate at right angles to said grouping conveyor, a driving device for said cross-conveyor, a proximity switch and a timing cam connected to said driving device to send signals at predetermined intervals according to its drive, and to convey grouped articles dropped from said shuttle plate in a line abreast with predetermined spacing or a multiple of predetermined spacing;

said shuttle plate being disposed at one lateral side of said grouping conveyor, said grouped articles waiting on said shuttle plate until said signal from said proximity switch on said timing cam is sent, said shuttle plate being drawn rapidly in the direction of said cross-conveyor to drop said grouped articles on it onto said cross-conveyor by said signal to convey said grouped articles in a line abreast on said cross-conveyor with predetermined spacing or a multiple of predetermined spacing, said shuttle plate not being drawn when said signal is sent before said grouped articles are pushed off by said pusher.

3. Apparatus for conveying and grouping articles comprising two or more grouping devices for grouping articles in a row and arranged parallel to each other, including respectively a feeding conveyor for conveying articles to deliver received articles to a grouping conveyor, a photo cell disposed at the delivery end of said feeding conveyor to generate a signal for counting the number of articles delivered and for intermittently driving said grouping conveyor through an electric relay, at least one grouping conveyor adjoining said feeding conveyor, having a driving device including a motor and clutch brake unit, an article counting device, a stopper at the delivery end of said conveyor, said conveyor being driven and stopped intermittently by a signal from said photo cell to group articles in a row apart from following articles being driven until the foremost article of a lined group reaches said stopper after grouping a predetermined number of articles and is stopped, a pusher moveable across said grouping conveyor for pushing off said grouped articles to one lateral side of said grouping conveyor;

a cross-conveyor disposed at right angles to said grouping conveyors and below said grouping conveyors or on a same level with said grouping conveyor, having proximity switches and timing cam in its driving device to send signals to each said grouping device at predetermined intervals respectively, and to convey said grouped articles transferred from each said grouping devices in a line abreast with predetermined spacing or a multiple of predetermined spacing;

shuttle plates disposed at one lateral side of each said grouping conveyors except said grouping conveyor arranged above said cross-conveyor at the feed end of said cross-conveyor, for receiving said grouped articles pushed off by said pusher, on which said grouped articles wait until said signal is sent, said shuttle plates being drawn rapidly in the direction of said cross-conveyor to drop said grouped articles on it onto said cross-conveyor by said signal to convey said grouped articles in a line abreast on said cross-conveyor with predetermined spacing or multiple of predetermined spacing, said shuttle plates not being drawn when said signal is sent before said grouped articles are pushed off by said pusher;

stopper mounted on said cross conveyor near its feed end to stop said grouped articles pushed off by said pusher from said grouping conveyor and conveyed in a line abreast on said cross conveyor, at the back side of which cross conveyor said grouped articles wait until said signal sent and released by said signal to convey in a line abreast with predetermined spacing or a multiple of predetermined spacing, which does not open when said signal is sent before said grouped articles reach the back side of the cross conveyor, final grouping means arranged at near delivery end of said cross conveyor to group in plural lines abreast said grouped articles conveyed in a line abreast on said cross conveyor for making a final formed group ready for loading in a tray.

4. Apparatus for conveying and grouping articles comprising a first grouping device including a feeding conveyor, a detector, a grouping conveyor, and a pusher; a second grouping device including a feeding conveyor, a detector, a grouping conveyor, a pusher and a shuttle plate arranged substantially parallel to each other; a cross conveyor, said second grouping device being disposed in the neighborhood of an outlet end of said cross conveyor arranged to cross said grouping conveyors;

a loader arranged at the delivery end of said cross conveyor, which loader has a loading conveyor for receiving said finally formed group of articles to be loaded onto a tray, said loader having means for vertical movement of the delivery end of said loading conveyor; a photo cell at near its delivery end to recognize said group of articles conveyed and to start the loading cycle; a conveyor beneath said loading conveyor for conveying the tray to be loaded with said group of articles with nearly the same speed as said loading conveyor, and two stoppers for conveying said tray one after another.

5. Apparatus for conveying and grouping articles comprising two or more grouping devices for grouping articles in a row, arranged parallel to each other, including respectively a feeding conveyor for conveying articles to delivery received articles to a grouping conveyor, a photo cell disposed at the delivery end of said feeding conveyor to generate a signal for counting the number of articles and for intermittently driving said grouping conveyor through an electric relay, a grouping conveyor adjoining said feeding conveyor, having a driving device including a motor and clutch brake unit, an article counting device, a stopper at the delivery end of said grouping conveyor, said grouping conveyor being driven and stopped intermittently by signals from said photo cell to group articles in a row apart from following articles being driven until the foremost article of a lined group reaches said stopper after grouping a predetermined number of articles and then stopped;

and a pusher moveable across said grouping conveyor for pushing off said grouped articles to one lateral side of said grouping conveyor;

final grouping conveyors disposed at right angles to said grouping conveyors and each adjoining its feed end to one lateral side of said grouping conveyors respectively, said final grouping conveyors being driven and stopped intermittently whenever said pusher pushed off said grouped articles in a row to make a final group of articles in plural lines abreast ready for loading in a tray;

waiting conveyors adjoining said final grouping conveyors respectively to receive said final group of articles therefrom and to make said final group of articles wait on the waiting conveyors until said final group of articles transfers to a cross conveyor at a predetermined spacing by an electric signal from a proximity switch and a timing cam in the driving device of said cross conveyor;

a cross conveyor disposed at right angles to said grouping conveyors and beneath said grouping conveyors, said final grouping conveyors and said waiting conveyors, said cross conveyor adjoining its feed end to the delivery end of said waiting conveyor, said cross conveyor having proximity switches and a timing cam in its driving device to send said electric signals to each waiting conveyor to transfer on it at predetermined intervals respectively, and to convey said final group of articles with predetermined spacing or multiple of predetermined spacing.

6. Apparatus for conveying and gathering articles comprising a first grouping device including a feeding conveyor, a detector, a grouping conveyor, a pusher; a second grouping device including a feeding conveyor, a detector, a grouping conveyor, a pusher and a shuttle plate arranged substantially parallel to each other; a cross conveyor, said second grouping device being disposed in the neighborhood of the outlet end of said cross conveyor arranged to cross said grouping conveyors;

a transmitter for providing instructions to transfer or conveyance from said shuttle plate or other waiting devices to said cross conveyor by means of cams driven by a driving device of said cross conveyor; limit switches;

a loader arranged at the delivery end of said cross conveyor, which loader has a loading conveyor for receiving said finally formed group of articles to be loaded in a tray, said loader having means for vertical movement of the delivery end of said loading conveyor; a detector at near the loader's delivery end to recognize said group of articles conveyed and to start the loading cycle; a conveyor beneath said loading conveyor for conveying the tray to be loaded with said group of articles with nearly the same speed as said loading conveyor; and two stoppers for conveying said tray one after another.

* * * * *